US005683351A

United States Patent [19]

Kaiser et al.

[11] Patent Number: 5,683,351

[45] Date of Patent: Nov. 4, 1997

[54] CONTINUOUS PASSIVE MOTION DEVICE FOR A HAND

[75] Inventors: Robert T. Kaiser, Mount Laurel; Vero Ricci, Collingswood, both of N.J.; George Telepko, Fort Washington, Pa.; Mark Covey, Marlton; Berdj C. Kalustyan, Moorestown, both of N.J.

[73] Assignee: Jace Systems, Inc., Mount Laurel, N.J.

[21] Appl. No.: 313,693

[22] Filed: Sep. 27, 1994

[51] Int. Cl.[6] ..... A61H 1/00

[52] U.S. Cl. ..... 601/40; 601/33

[58] Field of Search ..... 601/5, 33, 40; 482/44–46

[56] References Cited

U.S. PATENT DOCUMENTS

| | | | |
|---|---|---|---|
| 286,206 | 10/1883 | Lavery . | |
| 585,799 | 7/1897 | Thompson . | |
| 864,583 | 8/1907 | Wolfley . | |
| 1,204,437 | 11/1916 | Heinze . | |
| 1,256,687 | 2/1918 | Haas . | |
| 1,270,489 | 6/1918 | Brown . | |
| 1,340,329 | 5/1920 | Doman . | |
| 1,534,274 | 1/1925 | Krump . | |
| 1,964,109 | 6/1934 | Cusset . | |
| 2,004,671 | 6/1935 | Nelson | 601/5 |
| 2,124,116 | 7/1938 | Moore . | |
| 2,353,129 | 7/1944 | Mona . | |
| 2,553,277 | 5/1951 | Robinson et al. . | |
| 2,615,683 | 10/1952 | McCallum . | |
| 2,927,482 | 3/1960 | Costello . | |
| 3,020,908 | 2/1962 | Daniels et al. . | |
| 3,105,254 | 10/1963 | Benick . | |
| 3,457,912 | 7/1969 | Clark et al. . | |
| 3,631,542 | 1/1972 | Potter . | |
| 3,719,184 | 3/1973 | Kobayashi . | |
| 3,756,222 | 9/1973 | Ketchum . | |

(List continued on next page.)

FOREIGN PATENT DOCUMENTS

| | | | |
|---|---|---|---|
| 0078093 | 4/1982 | European Pat. Off. . | |
| 151085 | 8/1985 | European Pat. Off. | 601/40 |
| 0206455 | 11/1923 | United Kingdom . | |
| 0265448 | 2/1927 | United Kingdom . | |

OTHER PUBLICATIONS

Brochure: *Mobilimb™ H3 Hand CPM*, Bulletin MMH3BR2, Toronto Medical, Ontario, Canada, Oct. 1992, 2 pp.

Chesher, S. et al., "A New Early–mobilization Splint for Proximal Interphalangeal Joint Replacements", *Journal of Hand Therapy*, Oct.–Dec. 1988, 200–203.

Fess, E. E., "Convergence Points of Normal Fingers in Individual Flexion and Simultaneous Flexion", *Journal of Hand Therapy*, Jan.–Mar. 1989, 12–19.

Brochure: KINETEC® Hand and Wrist Continuous Passive Motion Machine, COGEMO S.A., Tournes, France (U.S. Distributor: Richards Medical Company, Memphis, TN), Apr. 1987, 2 pp.

Advertisement: Hand Therapy Assist Model CM–4, Bardon Enterprises, Inc., Hampton, VA, date unknown (before filing date).

*Primary Examiner*—Jeanne M. Clark

*Attorney, Agent, or Firm*—Panitch Schwarze Jacobs & Nadel, P.C.

[57] ABSTRACT

A therapeutic continuous passive motion device for rehabilitating a user's hand that includes a prime mover which provides for reciprocating motion. The therapeutic passive motion device comprises first, second and third links which cause the fingers of a user's hand to be moved in a path substantially defined by an epicycloid curve. The device can be configured to flex only MCP or only DIP and PIP joints or all three sets of joints. The therapeutic passive motion device applies a perpendicular force to the fingers so as not to irritate the tissue surrounding the bones of the fingers receiving recuperative therapy.

32 Claims, 19 Drawing Sheets

U.S. PATENT DOCUMENTS 3,850,166 11/1974 Tamny et al. .
3,937,215 2/1976 Barthlome .
4,020,708 5/1977 Obra ..... 74/52
4,274,399 6/1981 Mummert .
4,368,728 1/1983 Pasbrig .
4,487,199 12/1984 Saringer .
4,522,197 6/1985 Hasegawa .
4,537,083 8/1985 Saringer .
4,538,595 9/1985 Hajianpour ..... 601/34
4,576,148 3/1986 Koerner et al. .
4,596,240 6/1986 Takahashi et al. .
4,607,625 8/1986 Schenck .
4,644,938 2/1987 Yates et al. .
4,665,900 5/1987 Saringer .
4,671,258 6/1987 Barthlome .
4,679,548 7/1987 Pecheux .
4,724,827 2/1988 Schenck .
4,772,012 9/1988 Chesher .
4,817,463 4/1989 Cameron .
4,822,027 4/1989 Kascak .
4,842,265 6/1989 Kirk .
4,867,140 9/1989 Hovis et al. .
4,875,469 10/1989 Brook et al. .
4,962,756 10/1990 Shamir et al. .
5,067,479 11/1991 Saringer et al. ..... 601/40
5,115,806 5/1992 Grauloch et al. .
5,178,137 1/1993 Goor et al. ..... 601/40
5,255,188 10/1993 Telepko ..... 601/40
5,327,882 7/1994 Saringer et al. ..... 601/40

Fig. 22(A)
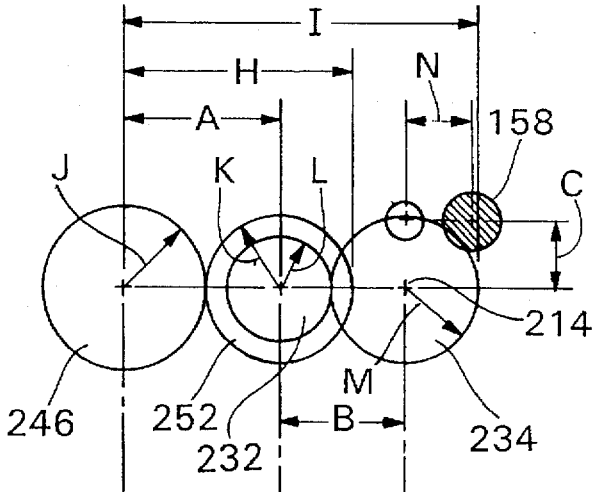
Fig. 22(B)
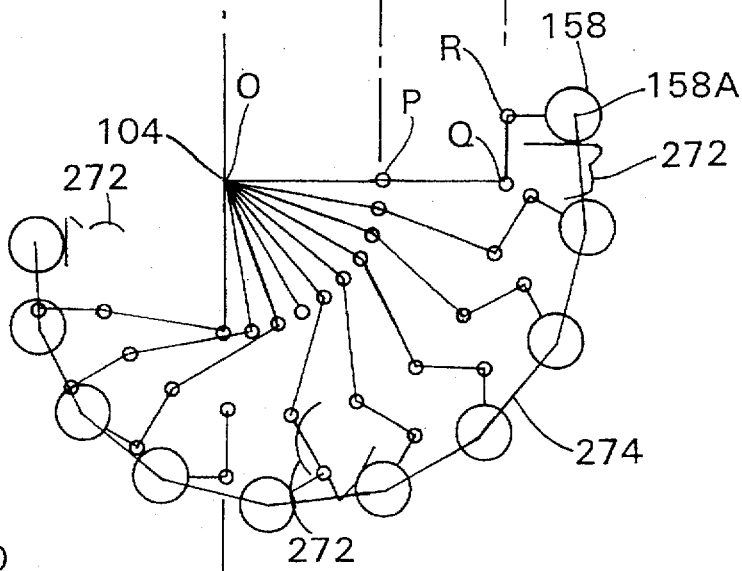
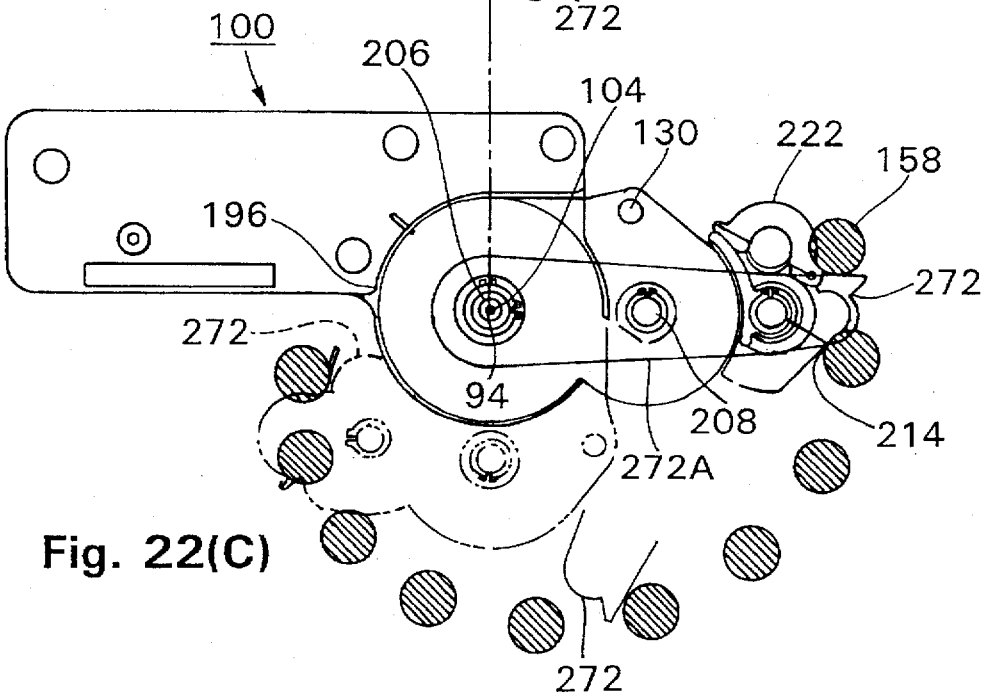
Fig. 22(C)

CONTINUOUS PASSIVE MOTION DEVICE FOR A HAND

FIELD OF THE INVENTION

The present invention relates to devices which effect continuous passive motion of a limb or joint. More particularly, the present invention relates to portable devices which produce continuous and/or cyclic movements in a human hand while the hand remains in a passive state.

BACKGROUND OF THE INVENTION

In the field of post-trauma and post-operative physical therapy for the rehabilitation of joints, it is generally known that the occurrences of capsular, ligamentous and articular adhesions, thromboembolisms, venous status, post-traumatic osteopenia, peripheral edema, muscle atrophy and the like can be reduced by an early mobilization of the injured or surgically treated joint with a continuous passive motion (CPM) device.

Various continuous passive motion devices have been proposed for effecting post-trauma or post-operative movements of an injured or surgically treated limb or joint. These devices are often driven by an electric motor and operate to continuously and repeatedly flex the affected or associated joint at a predetermined speed and through a predetermined range of motion. Moreover, these devices may be specifically adapted for use in conjunction with a particular joint, such as a knee, elbow, wrist or hand. An example of a motor driven CPM device that is specifically adapted for use in the rehabilitation of a wrist is disclosed in U.S. patent application Ser. No. 08/116,316, filed Sep. 3, 1993 and entitled "Continuous Passive Motion Device for a Wrist," assigned to the assignee of the present invention and incorporated by reference herein.

A continuous passive motion (CPM) device comprising a two link mechanism that moves one or more of the fingers or digits of the user in a reciprocating spiral path is known, for example, from U.S. Pat. No. 5,115,806 ('806). The continuous motion device of the '806 patent exercises each of the digits by causing flexion and extension thereof which is advantageous in recuperative therapy. However, we have determined, as is to be described herein, that the recuperative therapy can be enhanced when the force applied to the finger is perpendicular to the bone of the finger receiving therapy. More particularly, when the force is applied to the finger is perpendicular relative to its associated joints, the force causes the bone to rotate about its joint. This, in turn, causes minimum motion of the soft tissue surrounding the bone of the finger and, thereby, minimum tissue irritation. Minimum tissue irritation contributes to the effectiveness of the recuperative therapy. We have also determined, as is to be described herein, that the effectiveness of the recuperative therapy can be improved if one or more fingers are moved through an epicycloidal path rather than a spiral path.

Accordingly, it will become apparent that a continuous passive motion (CPM) device for a hand that provides for a force that is applied perpendicular to the bone of the finger under therapy creates an anatomically correct composite movement thereof which provides enhanced recuperative therapy. Further, it will become apparent that a continuous motion passive (CPM) device for a hand that causes the fingers of a hand to be pushed into flexion and pulled into extension and doing so by moving the fingers along a substantially epicycloidal path also enhances the recuperative therapy being received by the one or more fingers.

SUMMARY OF THE INVENTION

Briefly stated, the present invention is directed toward a therapeutic passive motion device for effecting movement of the user's hand comprising carpal, metacarpal and phalanges bones, with the carpal bones forming the wrist that is connected to the forearm of the user. The passive motion device includes a hollow splint assembly, a prime mover, and first, second, and third links. The hollow splint assembly has a centerline and is configured to be secured around a forearm and/or to the hand of the user. The prime mover is coupled with the splint assembly and includes a rotary output member. The prime mover is supported onto one side of the splint assembly so as to be located on one side of the user's hand when the splint assembly is worn by the user. The first link is coupled with the rotary output member for rotation about a first axis extending generally transversely to the centerline of the splint assembly. The second link is coupled with the first link for rotation about a second axis at least substantially parallel to and displaced transversely from the first axis. The third link is coupled with the second link for rotation about a third axis at least generally parallel to and displaced transversely from each of the first and second axes. According to the invention, the first, second and third links are mutually coupled together for oscillatory movement defined by a substantially epicycloidal curve. The location of the axes and angular range of rotation of the first, second and third links are predetermined to preferably and respectively match the desired anatomical rotation of the metacarpophalangeal (MCP), proximal phalanges (PIP) and distal phalanges (DIP) joints so as to create an anatomically correct composite hand movement for therapeutic purposes.

BRIEF DESCRIPTION OF THE DRAWINGS

The foregoing summary, as well as the following detailed description of the presently preferred embodiment(s) of the invention, will be better understood when read in conjunction with the appended drawings. For the purpose of illustrating the invention there is shown in the drawings an embodiment which is presently preferred. It should be understood, however, that the present invention is not limited to the particular arrangements and instrumentalities shown. In the drawings:

FIGS. 22(A), (B) and (C) illustrate the interrelationship between the first, second and third link mechanisms of the present invention and the epicycloidal path along which the fingers of the user are moved during recuperative therapy.

DETAILED DESCRIPTION OF THE PREFERRED EMBODIMENTS

Figure 1:
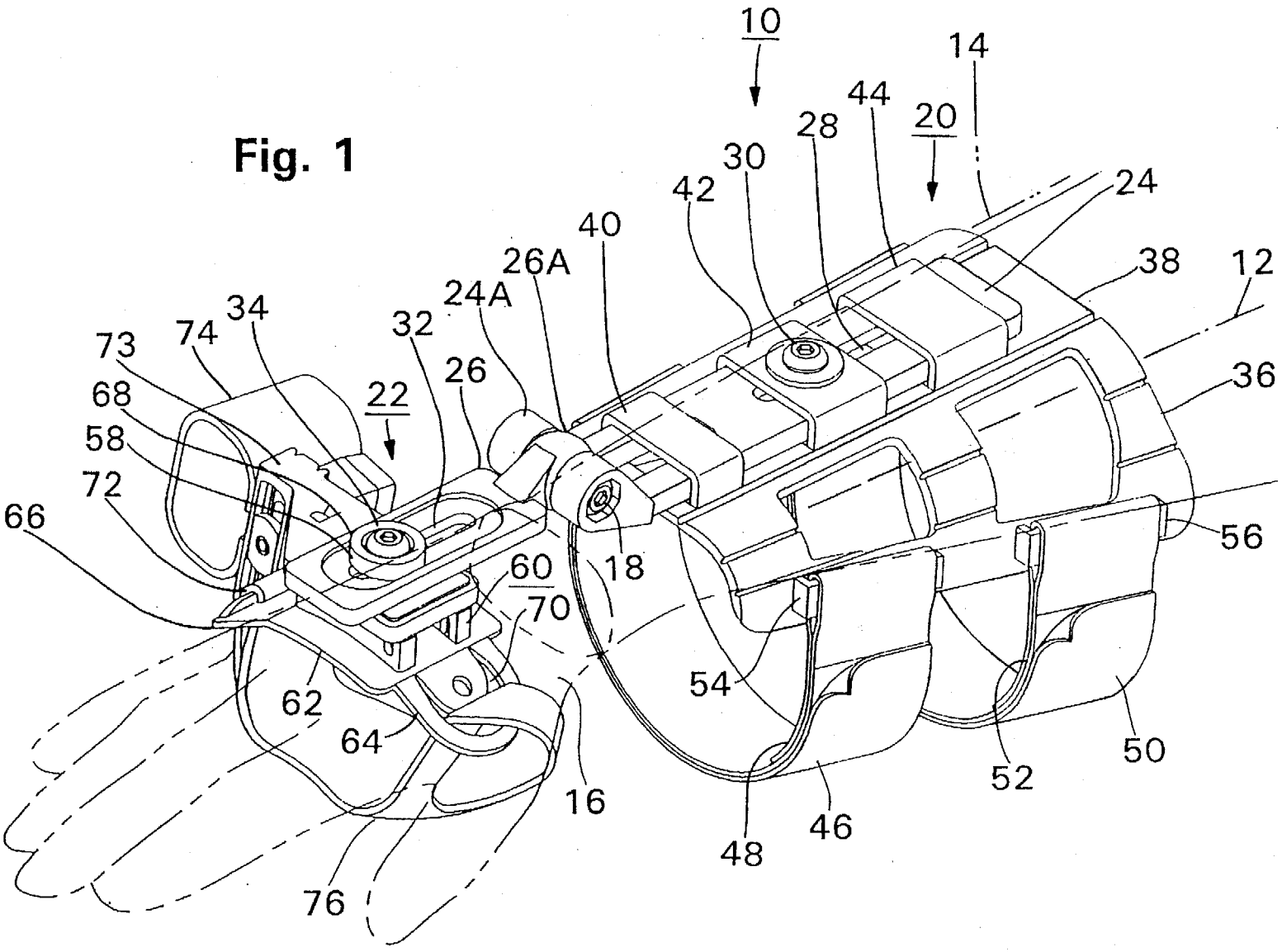
FIG. 1 is a perspective view of the splint assembly according to an embodiment of the invention which is attached to both the forearm and hand of a user.

Certain terminology is used in the following description for convenience only and is not limiting. For example, the words "right," "left," "lower," and "upper" designate directions in the drawings to which the reference is made. The words "above" and "below" refer to relative positions in the drawings to which reference is made. The words "inwardly" and "outwardly" refer to direction toward and away from the geometric center of the continuous passive motion (CPM) device of the present invention or designated parts thereof. The terminology will thus include the words above specifically mentioned, derivatives thereof, and words of similar import.

Furthermore, the CPM device of the present invention is referred to herein as providing controlled continuous passive motion of one or more of the fingers or digits of a patient's or user's hand. A human hand is made up of three types of bones which are carpals, metacarpals and phalanges, with the carpals forming the wrist which is connected to the forearm of the user. A patient's hand further comprises metacarpophalangeal (MCP), proximal phalanges (PIP), and distal phalanges (DIP) joints each of which have a desired, nominal, anatomical-angular range of motion. The CPM device causes the fingers of the user to be pushed into flexion and pulled into extension during recuperative therapy substantially approximating anatomical motion of the joints.

Referring now to the drawings in detail, wherein like numerals indicate like elements throughout, there is shown in FIGS. 1–22 a hand drive orthosis (HDO) unit or CPM drive device 100, a splint assembly 10 and associated accessories used during recuperative therapy all related to the practice of the present invention. The CPM device is especially suited to provide therapy for the human hand by mobilizing the joints of the fingers in an anatomically correct composite motion, and produces no joint expansion or compression and minimum irritation of the tissues of the user's hand. The CPM device is capable of producing only MCP joint motion or composite motion of all, MCP, DIP and PIP, finger joints. The preferred anatomical range of the MCP joint motion is 0°–90° , and the preferred anatomical range of the composite motion is 0°–260° which is the same range as occurring when one naturally forms a closed fist.

The splint assembly along with the associated accessories is primarily illustrated in FIGS. 1–15, whereas the CPM device is primarily illustrated in FIGS. 16–22. The CPM device is used in cooperation with either the splint assembly or with a combination of various accessories so as to provide an overall device herein termed "therapeutic passive motion device." The splint assembly may have several options of usage including immobilization of either or both the right and left wrists. Further, the accessories shown in FIGS. 4, 5, 8, 9, 10, 12, 13 and 14 provide for several options of usage including therapy for the MCP joint (FIG. 8), the DIP and PIP joints with MCP joint immobilized (FIGS. 9 and 10) and the MCP, DIP and PIP joints (FIGS. 12–14). The various therapy provided by the present invention is described with reference first to FIG. 1.

FIG. 1 illustrates a hollow splint assembly 10 which is hollow having a centerline 12 and is configured to be secured around the forearm 14 and hand 16 of a user. The splint assembly 10 is releasably joined first and second sections 20 and 22, respectively, positionable and adjustable along the forearm 14 and the hand 16. More particularly, the first and second sections 20 and 22 respectively comprise first and second adjustment arms 24 and 26. The first adjustment arm 24 has a yoke shaped end 24A the halves of which are connected together by a first fastener 18, which in one embodiment comprises a shaft having a threaded nut at one end, which is passed transversely through halves of the yoke 24A. The second adjustment arm 26 has a hollow, ball-shaped end 26A receiving the first fastener 18. This coupling allows the upward-downward pivoting of the second section 22 with respect to the first section 20 through rotation of ball-shaped end 26A in yoke 24A and on fastener 18.

The first adjustment arm 24 has a channel 28 that is longitudinally adjustable and lockable in position by a fastener 30, whereas the second adjustment arm 26 has a channel 32 that is longitudinally adjustable and lockable in position by a fastener 34. Accordingly, the first adjustable arm 24 is longitudinally positionable along the forearm 14, and the second adjustable arm 26 is longitudinally positionable along the hand 16. This enables the pivot coupling between 24A and 26A to be aligned with the user's wrist.

The first section 20 comprises a platform 36 preferably and generally contoured to match the upper surface of a typical forearm of a user. The first platform 36 has a top upper surface 38 on which the first adjustable arm 24 rides. The lateral movement of the first adjustable arm 24 is confined by strap members 40, 42 and 44. The first section 20 is releasably attached to the forearm 14 by means of pairs of intermeshing Velcro® straps 46 and 48, and 50 and 52, with strap 48 being held in place on the first platform 36 by means of an anchor member 54, and strap 52 being held in place to the first platform 36 by means of an anchor member 56.

The second section 22 is positionable along the user's hand 16 by means of fastener comprising the Allen head screw 34 (previously mentioned), a cup washer 58 that cooperates with the Allen head screw 34, a second platform 60 (commonly referred to as a palmar retainer) having a central member 62 from which generally transversely extend members 64 and 66. The palmar retainer 60 has a threaded connector opening 68 (see FIG.4), whereas the lateral members 64 and 66 have openings 70 and 72 respectively. The fastener that allows for the variable positioning of the second section 22 along hand 16 further comprises a hand drive orthosis (HDO) bridge assembly 73 with CPM clamping member 74 and a strap member 76, commonly referred to as a palmar splint. As seen in FIG. 1, the palmar splint 76 has a lower section that mates with the palm of the user's hand. The palmar splint 76 is further described with reference to FIG. 2.

Figure 2:
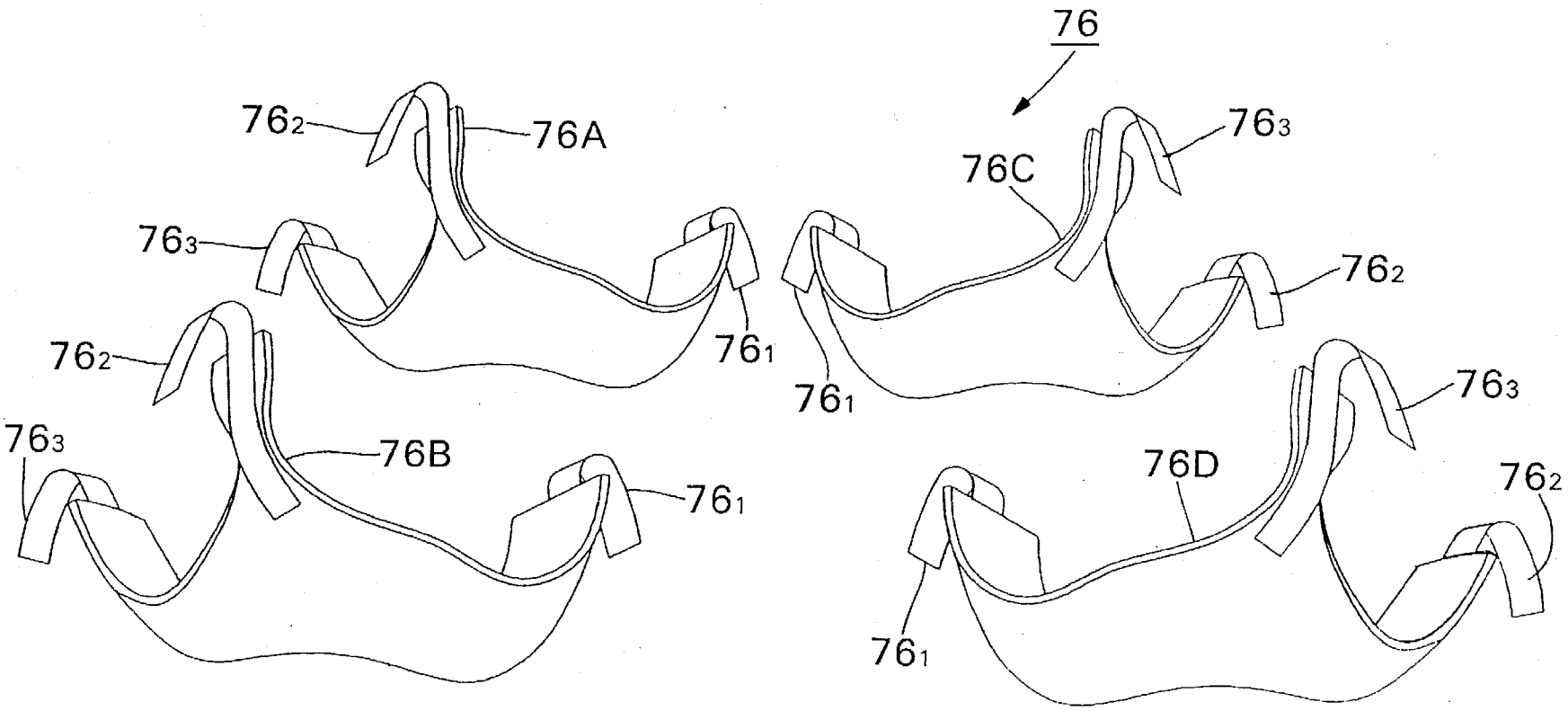
FIG. 2 is a perspective view illustrating various embodiments of palmar splints used in cooperation with the assembly of FIG. 1.

FIG. 2 illustrates various embodiments 76A, 76B, 76C and 76D of palmar splints respectively form fitted to mate with a relatively small left hand, a relatively large left hand, a relatively small right hand, and a relatively large right hand. Each of the palmar splints 76A, 76B, 76C and 76D has hook and loop straps $76_1$, $76_2$, and $76_3$ generally configured as shown in FIG. 2. Each of the selectable palmar splints 76 are preferably arranged with a foam liner 78 which is further described with reference to FIG. 3.

Figure 3:
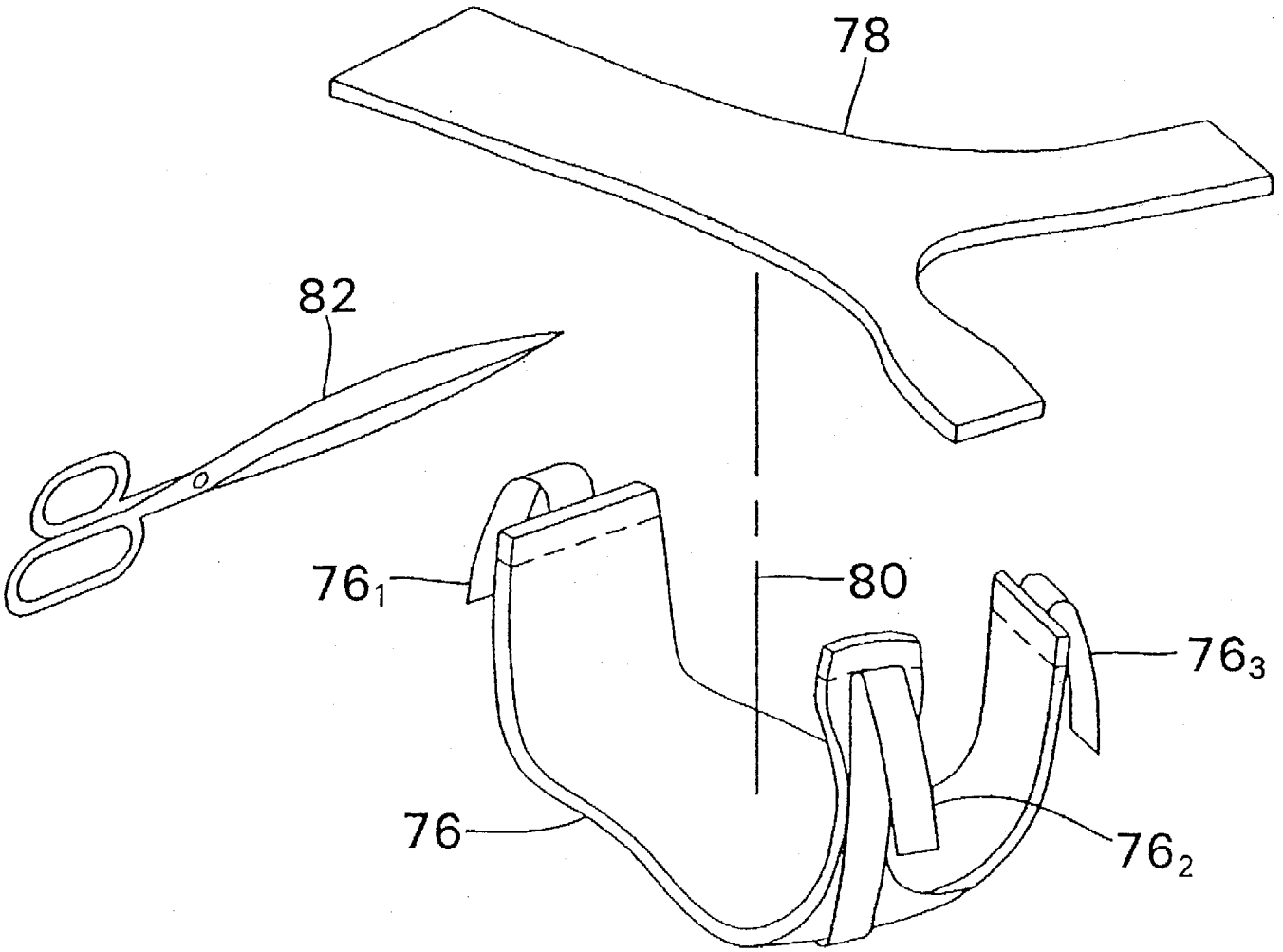
FIG. 3 is a perspective view illustrating the merging of a foam liner to one of the palmar splints of FIG. 2.

As seen in FIG. 3, the foam liner 78 is vertically oriented along line 80 so that it may be properly mated with the palmar splint 76. Any excessive material of foam liner 78 that overlaps the palmar splint 76 may be removed by a cutting instrument, such as a scissors 82 shown in FIG. 3. A foam liner 84 that provides a cushioning effect for use with the palmar retainer 60 is described with reference to FIG. 4.

Figure 4:
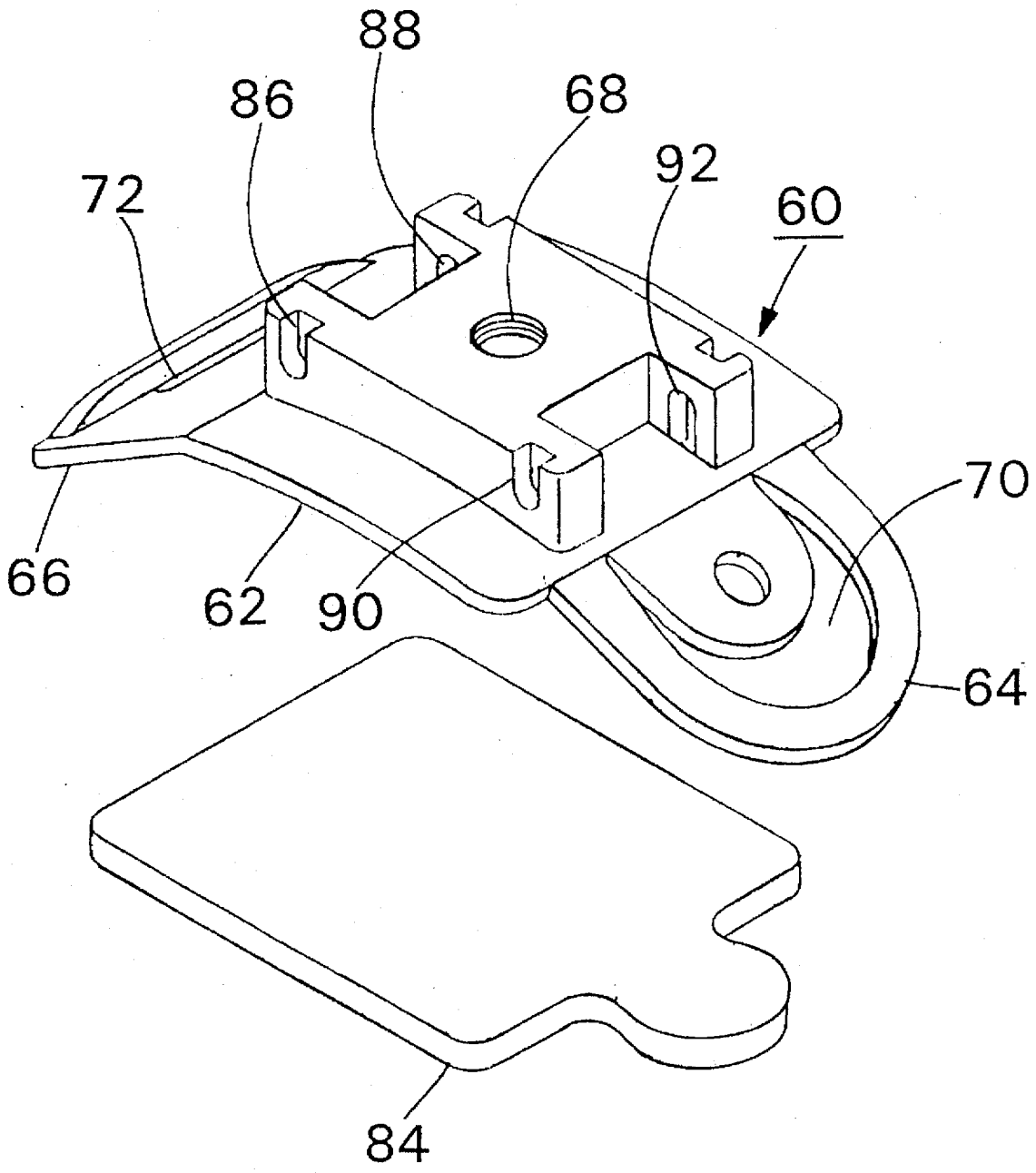
FIG. 4 is a perspective view illustrating details of a palmar retainer along with a related foam liner both used for various recuperative therapy options associated with the present invention.

As seen in FIG. 4, the foam liner 84 is positionable and located under the palmar retainer 60 which has a threaded fastener receiving opening 68 (previously mentioned). FIG. 4 further illustrates the opening 70 of the lateral member 64 and the opening 72 (preferably having the form of a slit) of lateral member 66. The palmar retainer 60 further comprises openings 86, 88, 90 and 92 each preferably having a groove shape as shown in FIG. 4. The palmar retainer 60 may be mated with any of the palmar splints of FIG. 2 and which mating is described with reference to FIG. 5.

Figure 5:
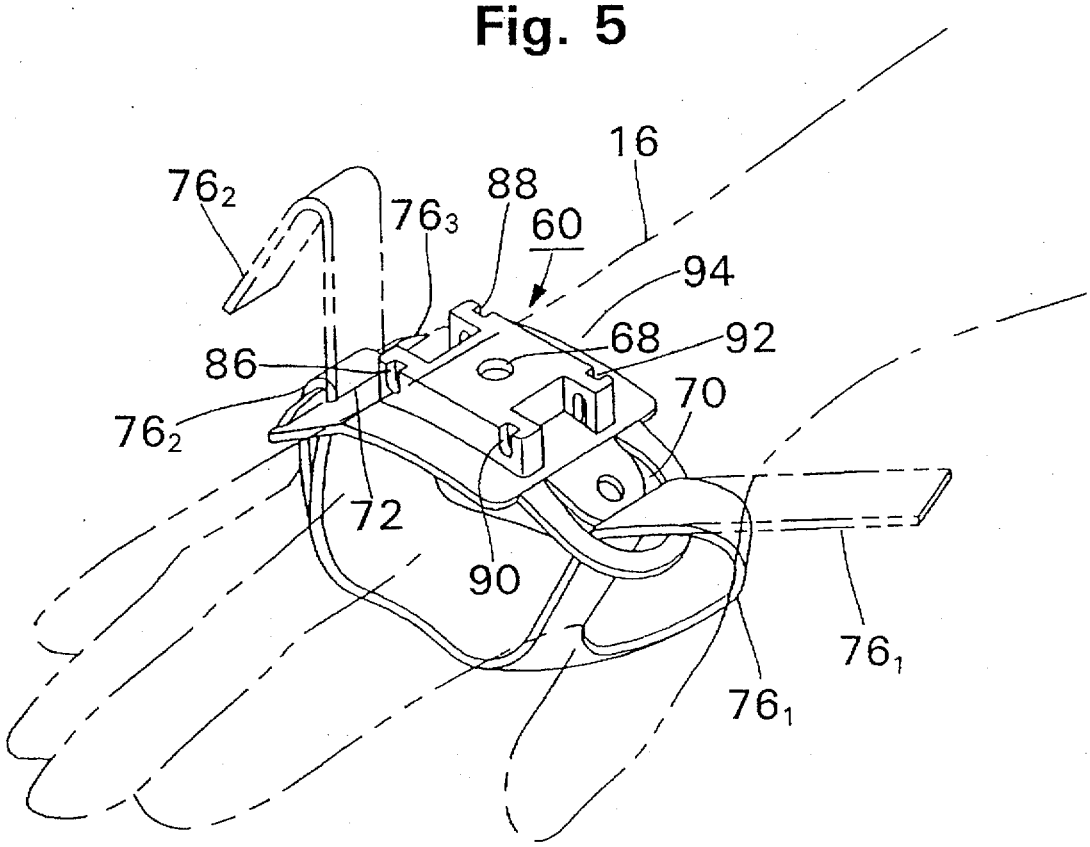
FIG. 5 is a perspective view illustrating a palmar retainer as being placed on the metacarpal bones of a user's hand.

As seen in FIG. 5, the hook and loop straps $76_1$, $76_2$ and $76_3$ of the palmar splint 76 are inserted into the openings (70 and 72) of the palmar retainer 60. The hook and loop straps $76_1$ and $76_2$ are shown to have both phantom and solid positions respectively indicating the unattached and attached conditions of the hook and loop straps $76_1$ and $72_2$, whereas hook and loop strap $76_3$ is only shown in its attached (solid) condition. The palmar retainer 60 is adjusted so as to be centered on the dorsum of the hand 16. More particularly, the palmar retainer 60, in most embodiments of the present invention, is positioned over the metacarpals of the hand 16. The mating of the palmar retainer 60 to the second section 22 of the splint assembly 10 is further described with reference to FIG. 6.

Figure 6:
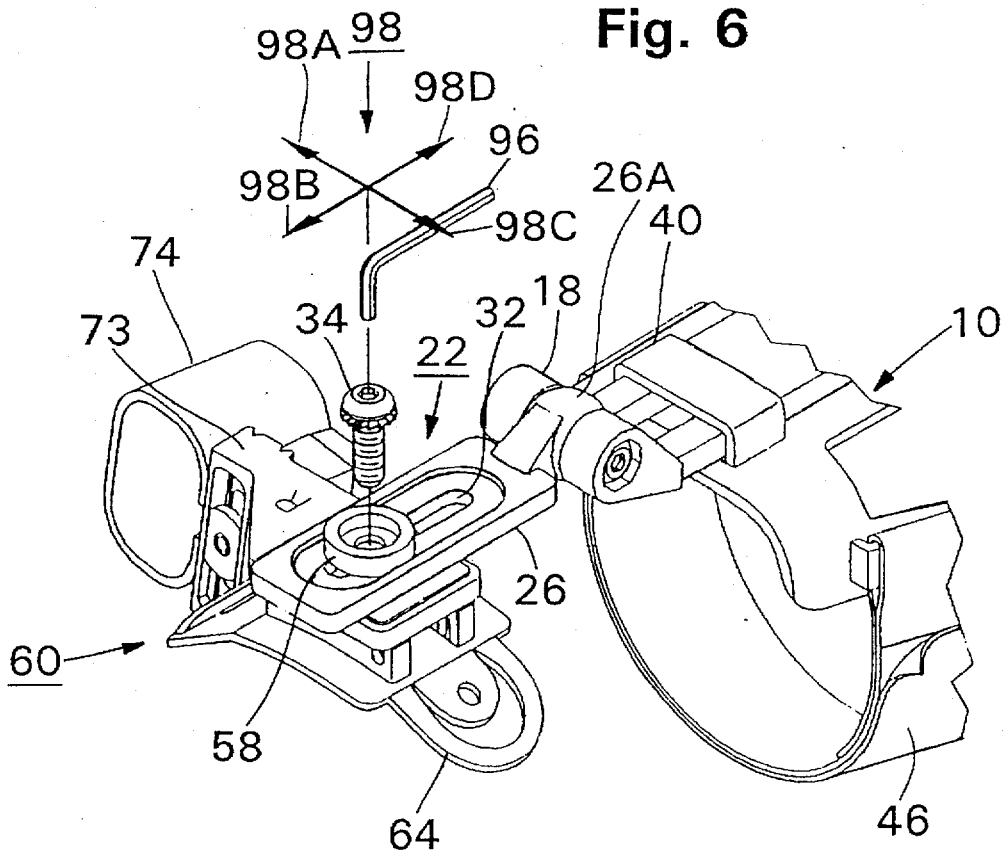
FIG. 6 is a perspective view illustrating details of the palmar retainer as attached to the splint assembly of the present invention.

FIG. 6 primarily illustrates the second section 22, in particular, that the second adjustment arm 26 may be easily connected to the palmar retainer 60 merely by the insertion of adjustment screw 34 through the hole of cup washer 58, through cavity 32 and into threaded opening 68 (FIG. 4) of the palmar retainer 60, and the tightening thereof by means of Allen wrench 96. FIG. 6 further illustrates a directional array 98 comprising arrow heads 98A, 98B, 98C and 98D pointing in the directions as shown. Still further, FIG. 6 illustrates the orientation of the palmar retainer 60 for the therapeutic treatment of a right hand. Screw 34 provides distal/proximal adjustment (arrows 98B and 98D) of arm 26 with respect to the palmer retainer 60 and lateral alignment (arrows 98A and 98B) with the hand drive orthosis assembly 73. The clamping member 74 serves as the means of the splint assembly 10 which allows the CPM drive device 100 of the present invention to be supported to one side of the user's hand and is further described with reference to FIG. 7.

Figure 7:
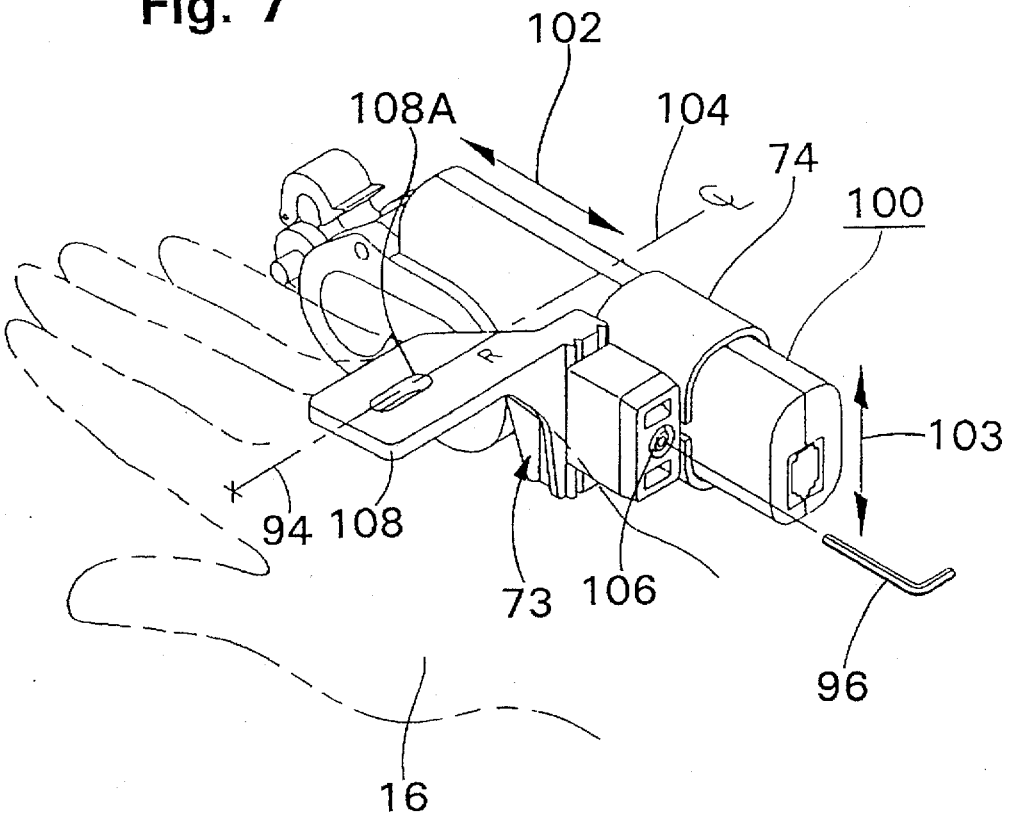
FIG. 7 is a perspective view illustrating the means to align of the drive axis of the therapeutic passive motion device of the present invention with the MCP joint of the user's hand.

FIG. 7 illustrates the clamping member 74, which is dimensioned to accept and releasably capture a portion of the CPM drive device 100 of the present invention that is longitudinally positionable in the directions indicated by bilateral arrow 102 and vertically positionable in the directions indicated by bilateral arrow 103, so that the drive axis 104 of the CPM drive device 100 is positioned in correspondence (i.e., substantial coincidence) with the fifth digit MCP joint center, generally indicated by reference number 94. The effective dimension of clamping member 74 is manually adjusted to accommodate the correct alignment of the drive axis 104 with the MCP joint 94 and, then is raised to the appropriate height on lateral arm 108 of assembly 73 and is fixed in position by tightening screw 106. After such adjustments, the assembly 73 may be reattached to the palmar retainer 60 by means of its lateral arm 108 having a lateral adjustment slotted opening 108A. More particularly, (see FIG. 1) the slotted opening 108A is positioned on the palmar retainer 60 beneath second adjustment arm 26 so as to be captured and held in position by screw 34. The second section 22 may then be used in cooperation with the remainder of the splint assembly 10 shown in FIG. 1 to provide for recuperative therapy. If desired, only the palmer retainer portion 60 of the splint assembly 10 need be used.

Figure 8:
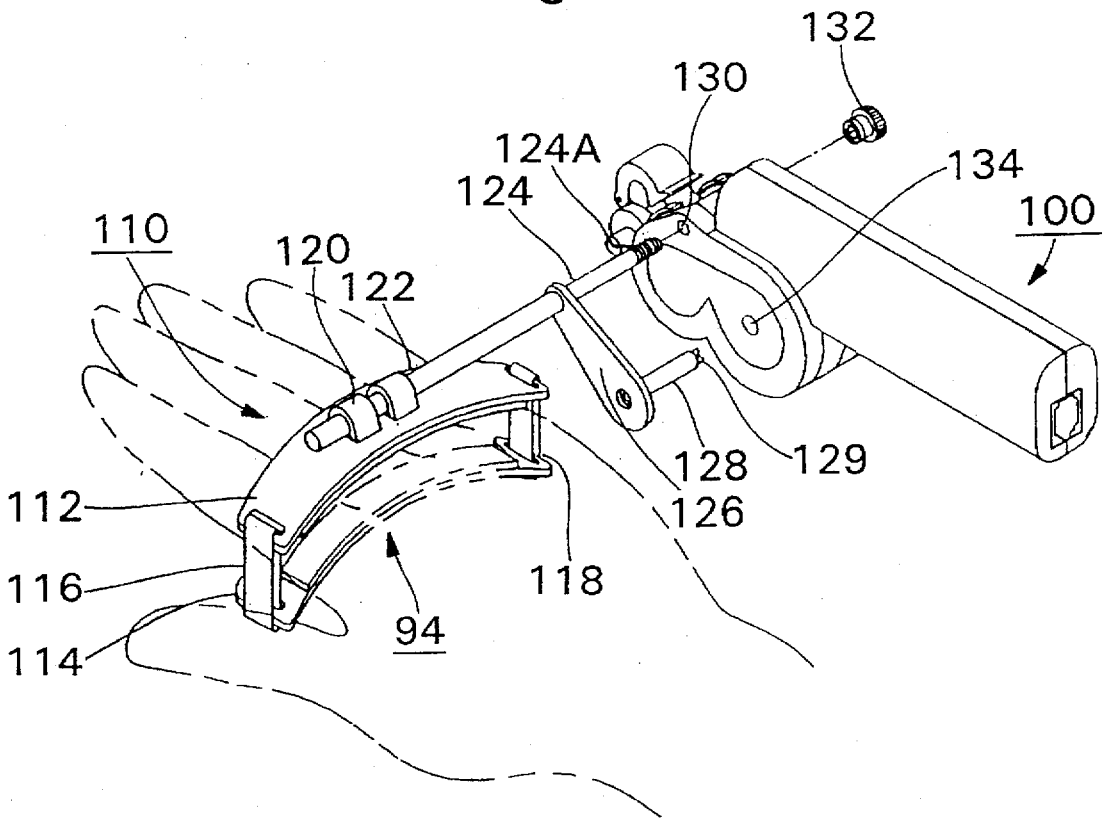
FIG. 8 is a perspective view illustrating the arrangement and orientation of the therapeutic passive motion device of the present invention used to provide motion so as to only treat the MCP joint of the user's hand and not the proximal phalanges (PIP) and distal phalanges (DIP) joints of the user's hand.

FIG. 8 illustrates a transverse member 110 comprising an upper portion 112, a lower portion 114, and vertical side portions 116 and 118. The palmer retainer 60, which provides support for CPM drive device 100, has been eliminated from the view for clarity. Use of the remainder of the splint assembly 10 is optional to the therapist in this and the following configuration. The upper portion 112 is preferably contoured to mate to the upper surface of the proximal phalanges in the hand, and, similarly, the lower portion 114 is contoured to mate with the lower surface of the proximal phalanges of the hand. The vertical portions 116 and 118 bring together the upper portion 112 and lower portion 114.

The upper portion 112 has at least one, but preferably two protrusions 120 and 122, each confining an opening therein and extending upward from the upper portion 112. If desired, the transverse member 110 may be a single piece having appropriate straps so as to be placed over and around the general region of the proximal phalanges so long as at least one protrusion 120 or 122 is provided therewith.

Transverse member 110 further comprises a main rod 124 to which is fastened an arm 126 having a protrusion 128 in the form of a rod with a permanent magnet inserted within its tip 129. The main rod 124 has a threaded end 124A that is inserted into and through an opening 130 of the CPM drive device 100 and is attached to CPM drive device 100 by a thumb nut 132. Similarly, the tip 129 of protrusion 128 is inserted into an opening 134 of the CPM drive device 100. Insertion of the magnet in tip 129 into the CPM drive device 100 is sensed by a magnetic sensor 280 (see FIG. 19), which switches states to alert the programmable controller to switch itself to an MCP controlling mode. After the transverse member 110 has been coupled to the CPM drive device 100, the MCP joint therapy may be accomplished, in a manner as to be herein described. The transverse member 110 (without protrusion rod 128) may be used to perform therapy of the PIP and DIP joints, while also inhibiting the motion of the MCP joint, which is further described with reference to FIGS. 9(A) and 9(B).

Figure 9A:
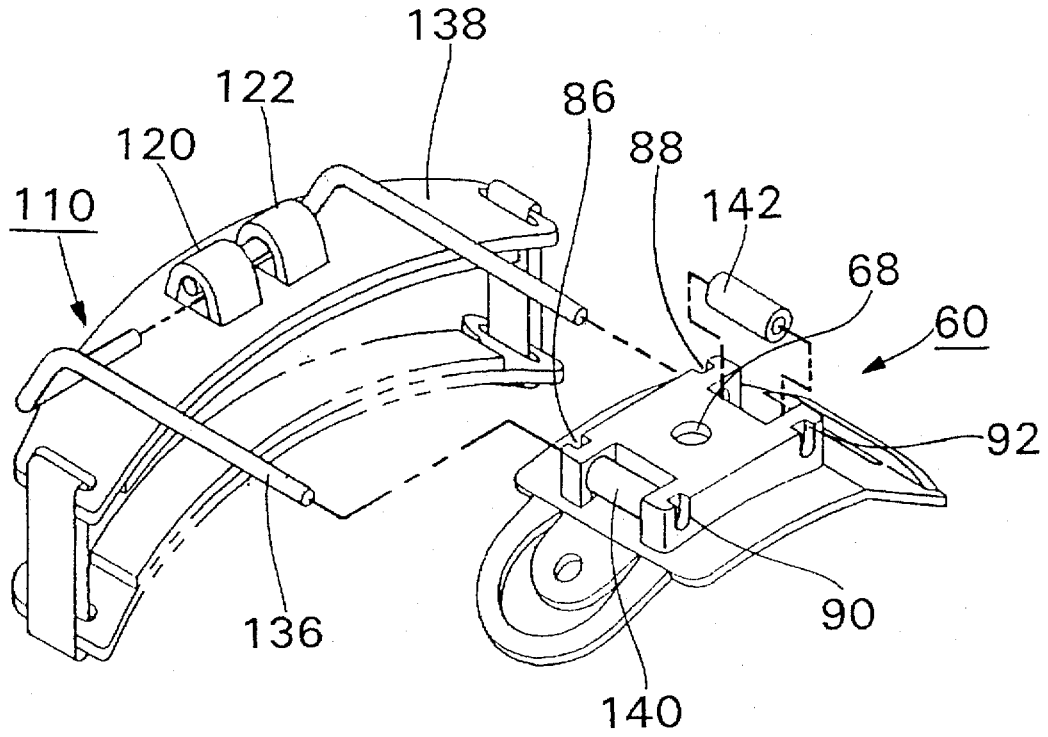
FIG. 9(A) illustrates the arrangement of accessories for preferably inhibiting the movement of the MCP joint when performing therapy on the PIP and DIP joints of the user's hand.

FIG. 9(A) illustrates the transverse member 110 as being interconnected to the palmar retainer 60 by means of a left support rod 136 and a right support rod 138, each of which have a curved end that inserts into the openings of both protrusions 120 and 122. Further, rod 136 has its other end inserted into the openings 86 and 90 of the palmar retainer 60, whereas rod 138 has its other end inserted into openings 88 and 92 of the palmar retainer 60. The rod 136 is retained to the palmar retainer 60 by means of a rubber retainer tube 140, whereas rod 138 is retained to the palmar retainer 60 by means of rubber tube 142. The relative vertical orientation established between the transverse member 110 and the palmar retainer 60 is provided by bending the rods 136 and 138 and is further described with reference to FIG. 9(B).

Figure 9B:
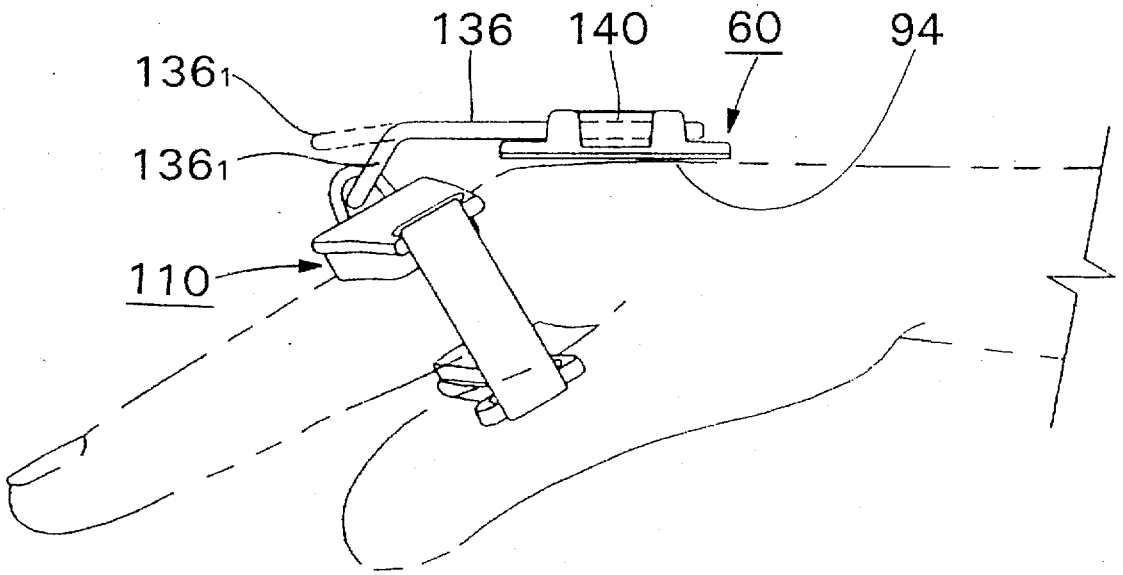
FIG. 9(B) is a side elevation view illustrating the elongation limit of travel of the user's hand during therapy of the associated PIP and DIP joints with MCP joint inhibited.

FIG. 9(B) illustrates the palmar retainer 60 as being placed over the proximal phalanges. FIG. 9(B) further illustrates the support rod 136 as having one end, that is $\mathbf{136}_1$, illustrated in both a solid and a phantom form. The solid form of end $\mathbf{136}_1$ is the position that the transverse member 110 obtains and maintains when the one end $\mathbf{136}_1$ is bent. This orientation of the transverse member 110 inhibits the MCP joints from encountering any movement when the PIP and DIP joints therapy is performed, and when such therapy is performed without the use of the remainder of the splint assembly 10 of FIG. 1. Other accessories used to provide motion so as to treat some or all of the MCP joints of the user's hand and not the proximal phalanges (PIP) and distal phalanges (DIP) joints of the user's hands are further shown with respect to FIGS. 10(A) and 10(B).

Figure 10A:
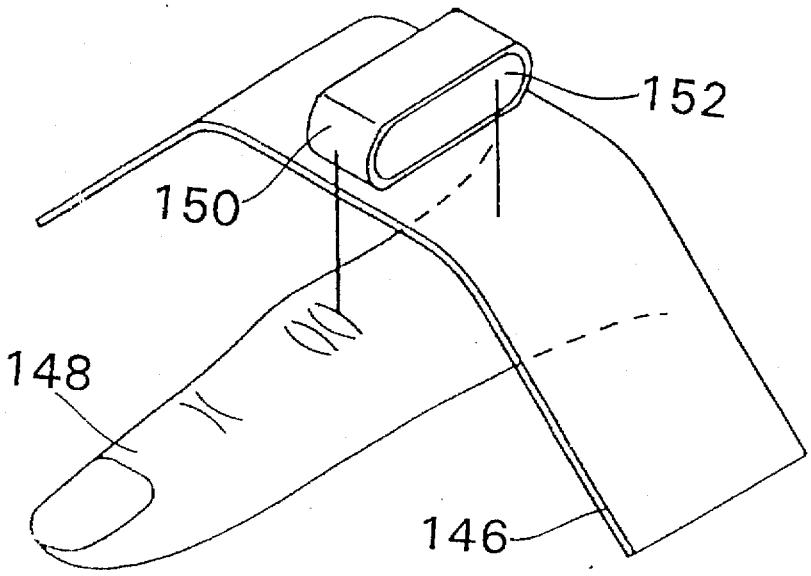
FIG. 10(A) is a perspective view illustrating the placement of one of the accessories of the finger-engaging bracket used during therapy of the MCP joint.

FIG. 10(A) illustrates a strap 146 being secured, preferably adhered around the proximal phalanx of a digit or finger 148. The strap 146 has a loop member 150 adhered or otherwise fixed on its upper outer surface. Loop member has an aperture 152 therein. An identical strap 146 is affixed to all of the fingers, except the thumb, which are to be exercised. The coupling of the individual digits 148 with the CPM drive device 100 is further explained with respect to FIG. 10(B).

Figure 10B:
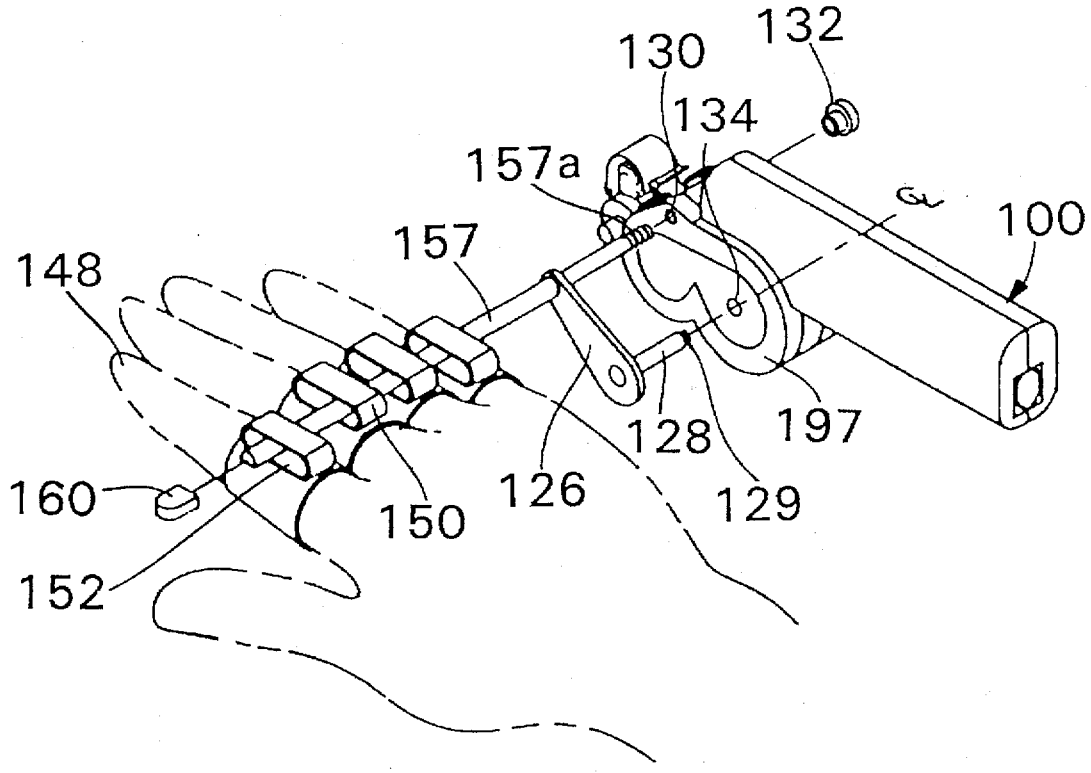
FIG. 10(B) is a perspective view illustrating the arrangement, orientation and interrelationship of the continuous passive motion (CPM) device of the present invention and the user's hand for the performance of flexion and extension of the user's MCP joints.

FIG. 10(B) depicts the coupling of each digit 148 bearing a strap 146 with the output drive of the CPM drive device 100. A drive bar 157 also bearing an arm 126 with protrusion 128 having a permanent magnet inserted within its tip 129 is provided passing through each of the provided finger straps 146. One end **157*a* of the drive bar is threaded and passed through an opening 130 of a main output member 197 where it is secured to the member 197 by thumb nut 132. At the same time, tip 129 of extension 128 is again inserted into the opening 134. Bar 157 has a flattened side which faces the digits 148 and presses against a flattened side of each strap 146. The bar 157 with arm 126 and extension 128 operate substantially the same as the main rod 124, arm 126 and extension 128 except that the contact of the flattened surface of the drive bar 157 against the proximal flattened surface of the straps 146 substantially prevents any rolling motion between the bar 157 and the straps 146, as sometimes occurs between the rod 124 and transverse member 110 during the last 30° of rotational movement of the rod 122**, to insure full flexion of the MCP joints.

Figure 11:
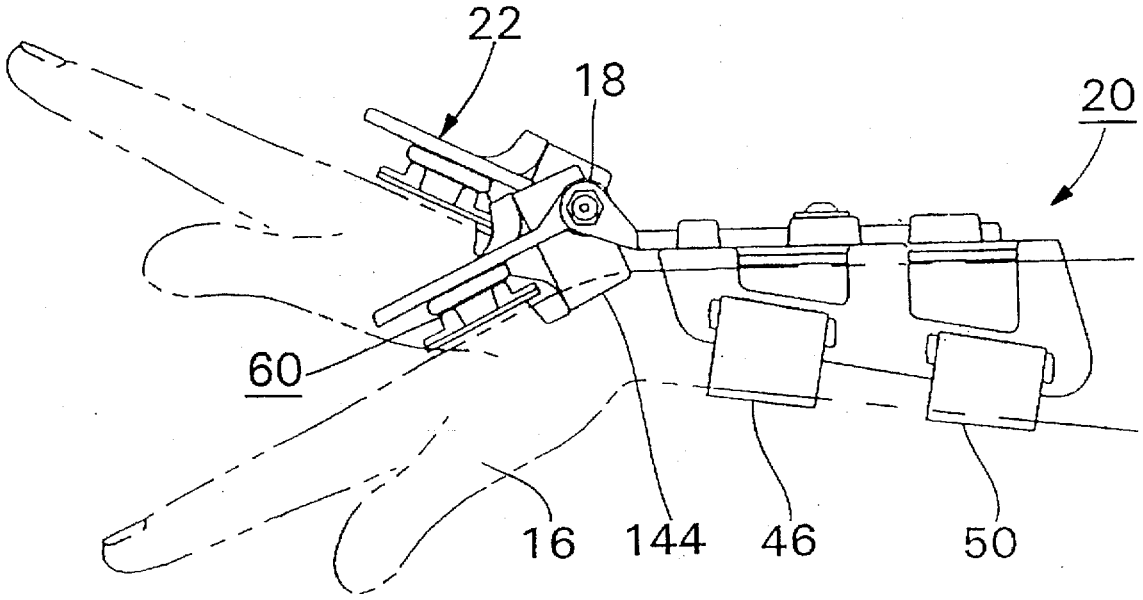
FIG. 11 illustrates the arrangement of the splint assembly oriented to obtain an overall desired angle of flexion and extension for the wrist of the user occurring during therapy.
Figure 12:
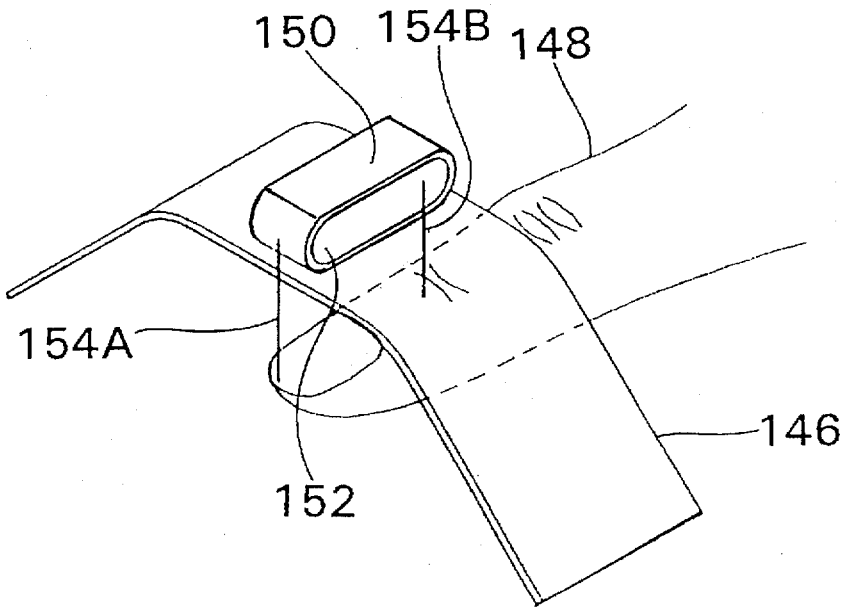
FIG. 12 is a perspective view illustrating the placement of one of the accessories of the finger-engaging bracket used for the therapy of all (MCP, DIP, and PIP) finger joints.

As FIG. 11 illustrates, the fastener 18 is positioned over the general wrist region 144 of the user's hand 16. Further, FIG. 11 illustrates that the hand 16 may be oriented in either a downward or an upward direction. The range of adjustment is provided by first loosening the first fastener 18, bending the wrist upward or downward to the extent desired and retightening the first fastener 18. Thus, the wrist may be immobilized at any desired angle along its normal range of up and down motion. The accessories which allow for the therapeutic treatment of all of the finger joints, that is the MCP, DIP and PIP joints, are now described with reference first to FIG. 12.

FIG. 12 illustrates one of the straps 146 as being adhered around the volar aspect of the distal phalanx of a digit or finger 148, with the loop member 150 aligned, as shown in FIG. 12, with the end of the finger tip along lines 154A and 154B. Identical straps 146 are affixed to all of the fingers, except for the thumb. A curved drive bar 158, which interconnects all four fingers so that all of the MCP, DIP and PIP finger joints of those fingers may be sequentially therapeutically treated, is further described with reference to FIGS. 13(A) and (B).

Figure 13A:
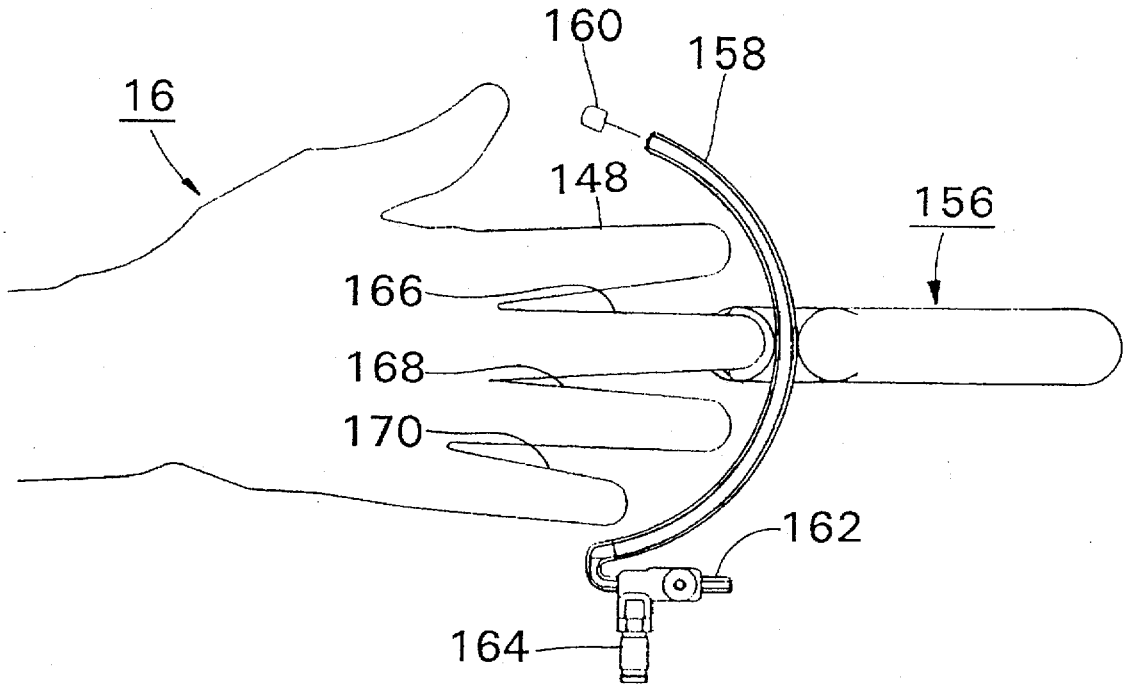
FIGS. 13(A) and (B) illustrate in top plan views the adjustment of the finger-engaging drive bar used during the therapy of the MCP, DIP and PIP joints.

FIG. 13(A) illustrates a bending tool 156, which is used to bend an interconnecting curved drive bar 158 so that the resulting shape of the bar 158 aligns with the distal phalanx tips of the digits 148, 166, 168 and 170. The curved drive bar 158 has one of its curved ends closed off by a removable end cap 160, which prevents the loops 150 from coming off the bar 158, and its other end carrying a drive bar support assembly including members 162 and 164. The arrangement in FIG. 13(A) of members 162 and 164 provides for an adjustable orientation for fingers that are longer than typical fingers, whereas the arrangement in FIG. 13(B) with member 162 reversed, provides for an adjustable orientation for fingers shorter than typical fingers.

As seen in FIG. 13(A) the drive bar 158 is curved and formed so as to conform to the configuration of fingers 148, 166, 168, and 170. The interconnection of the curved drive bar 158 to the fingers 148, 166, 168 and 170 so as to perform the MCP, DIP and PIP joint therapy is further described with reference to FIG. 14.

Figure 13B:
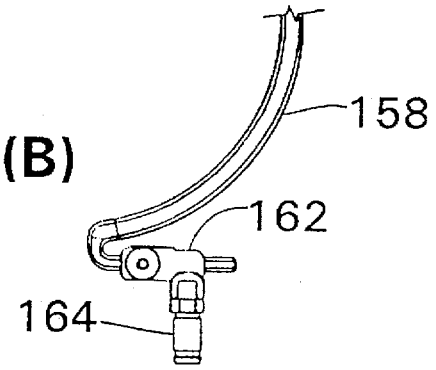
Figure 14:
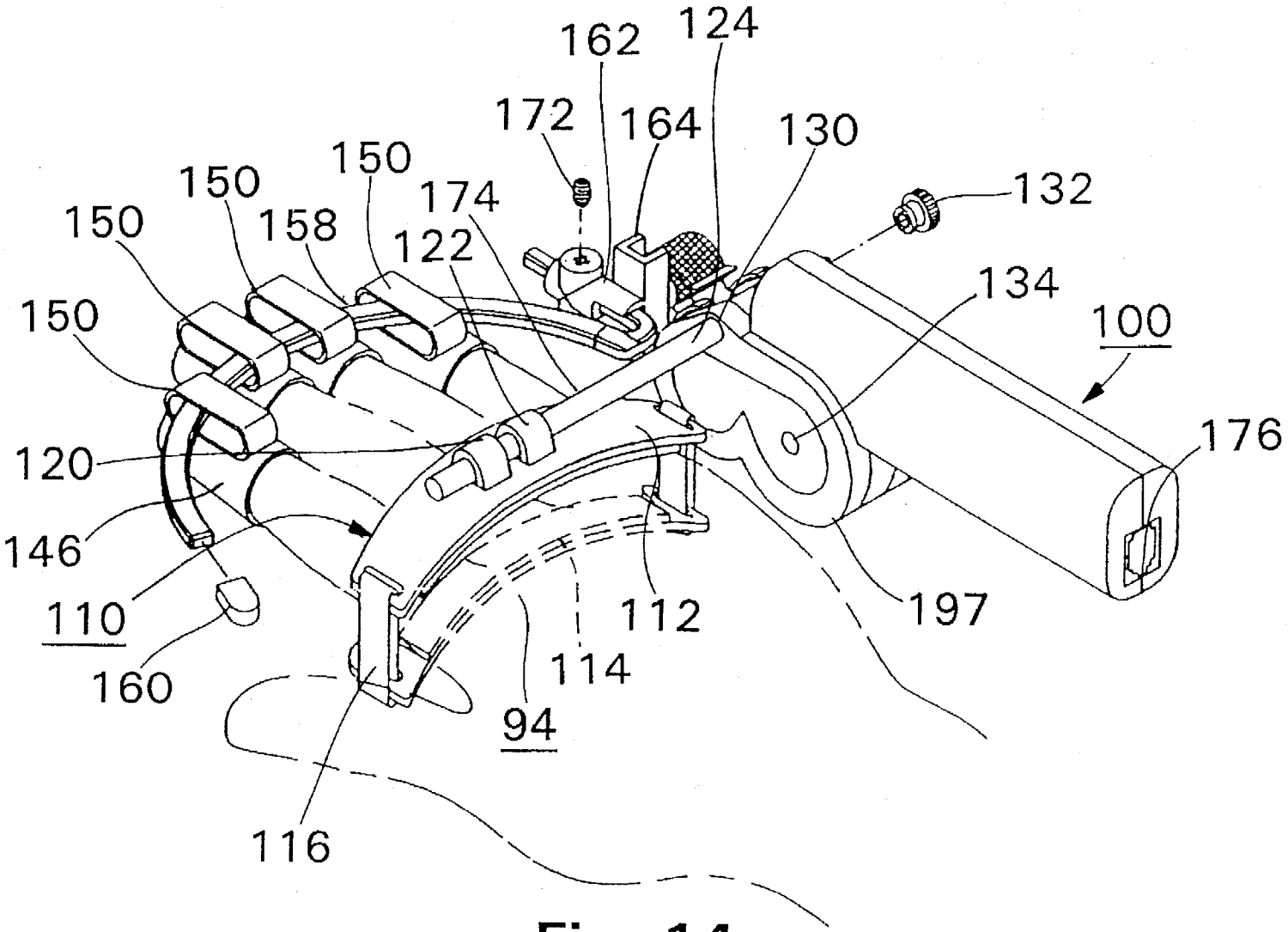
FIG. 14 is a perspective view illustrating the arrangement, orientation and interrelationship of the continuous passive motion (CPM) device of the present invention and user's hand for the performance of flexion and extension of the user's fingers respectively simulating the closing and opening of the fist of the user.

FIG. 14 illustrates the curved drive bar 158 as being inserted into and resting in each of the guide loop members 150 located on each of the four fingers, except for the thumb. The support 162 of either FIGS. 13(A) or 13(B) is affixed in position to the periphery of the extended drive of the CPM drive device 100 by means of Allen screw 172. Further, FIG. 14 further illustrates the transverse member 110 (previously discussed with reference to at least FIG. 8 associated with the MCP joint 94 therapy treatment) as being placed over the proximal phalanges. Unlike FIG. 8, the transverse member 110 of FIG. 14 is coupled to the CPM drive device 100 only by means of a rod 174 having a single threaded end only (not shown) that is engaged by the thumb nut 132. The absence of a signal from sensor 280 indicating the presence of protrusion 128 in recess 134 causes the controller programming to be switched to composite mode control. The CPM drive device 100 receives its external control signals by way of its input jack 176, which is further described with reference to FIG. 15.

Figure 15:
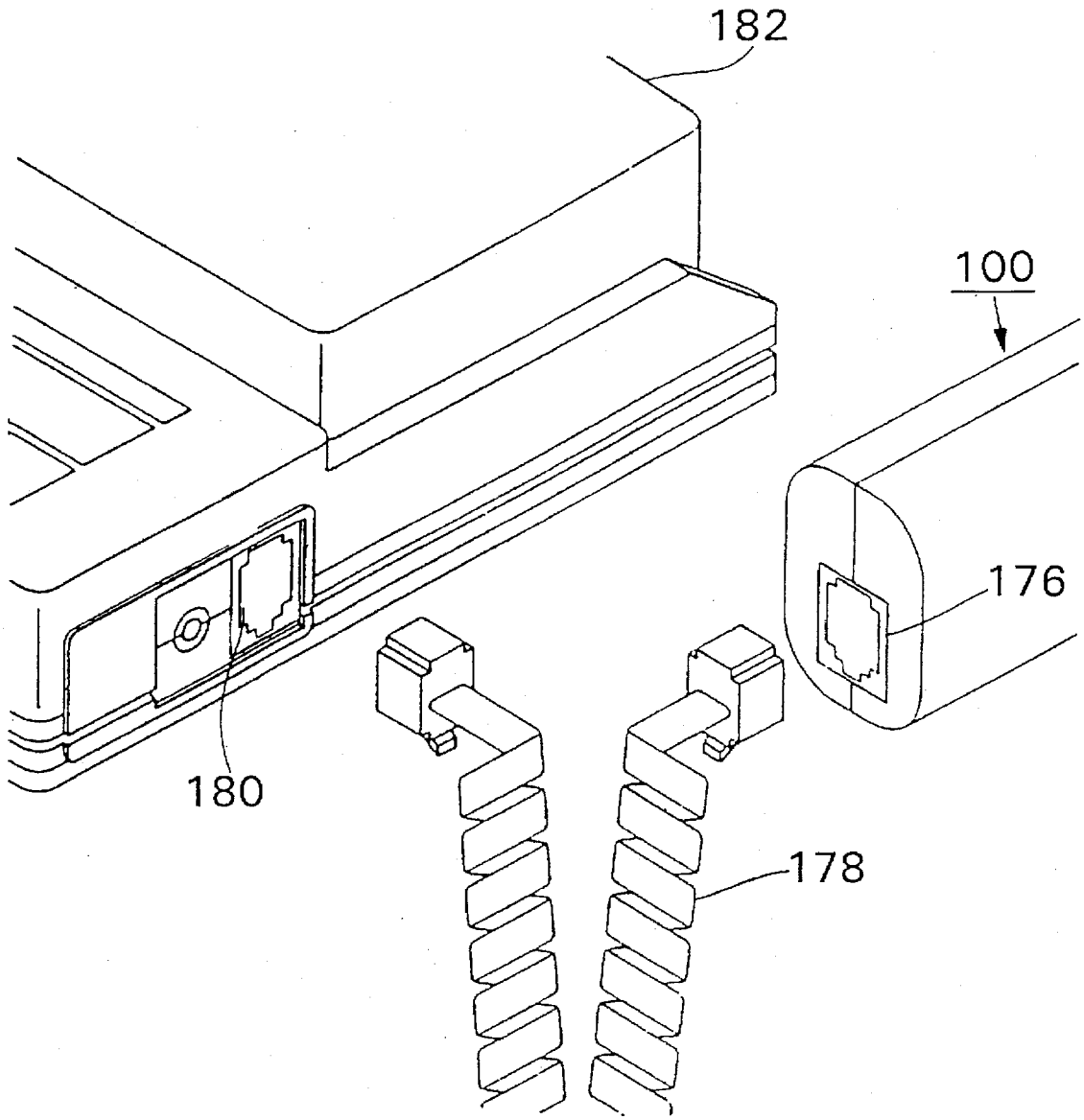
FIG. 15 is a perspective view illustrating the interconnection between the CPM device of the present invention and a processor programmed to provide the desired signals to control the speed, torque and rotation of the CPM device.

FIG. 15 illustrates the input jack 176 as positioned to receive one end of a cable 178 which has its other end positioned to be insertable into a connector 180 of a programmable controller or processor 182. The programmable controller or processor 182 may be of the kind described in U.S. patent application Ser. No. 07/760,424 entitled, "Controller for Continuous Passive Motion Devices," assigned to the assignee of the present invention and incorporated by reference herein. Processor 182 is programmed to control the prime mover of the CPM drive device 100 so that therapy can be performed only on the MCP joint 94 or, conversely, on all of the finger joints, that is, the MCP, DIP and PIP joints. The angular range of the MCP motion is preferably 0°–90° , and the angular range of the composite motion for the MCP, DIP and PIP joints is preferably 0°–260° . Cable 178 preferably has six (6) conductors (not individually depicted), the use of which herein after will be described.

In general, the processor 182 receives a signal from a linear potentiometer 278 (see FIG. 19), which is located in the CPM drive device 100 and which indicates the angular position of the main output member 197 of CPM drive device 100. The placement and location of the linear potentiometer 278 may be as described in the previously incorporated by reference U.S. patent application Ser. No. 08/116,316. In accordance with the sensing provided by the linear potentiometer 278 and other elements described in the U.S. patent application Ser. No. 08/116,316, as well as the sensing and its responsive operation described in U.S. patent application Ser. No. 07/760,424, the processor 182 provides signals to a prime mover 240A (see FIG. 19) of the CPM drive device 100 to control the speed, torque and reciprocating movement thereof.

When the CPM drive device 100 is performing the therapy for only the MCP joint(s), the processor 182 preferably is programmed to supply signals so that the CPM drive device 100 supplies a force to the MCP joint(s) anywhere in the range of about thirty-two (32) ounces to about three hundred and twenty (320) ounces. Further, when only treating the MCP joint(s) the processor 182 preferably is programmed so that the CPM drive device 100 moves the MCP joint(s) at any speed in the range from about eighteen (18) degrees/minute to about one hundred and seventy-six (176) degrees/minute. Conversely, when the CPM drive device 100 is performing therapy on all of the finger joints, that is the MCP, DIP and PIP joints, the processor 182 is preferably programmed so that the CPM drive device 100 supplies a perpendicular force to the finger tips anywhere in the range of about five (5) ounces to about eighty (80) ounces. Further, when all the finger joints are being therapeutically treated, the processor 182 is preferably programmed so that the CPM drive device 100 moves all of the MCP, DIP and PIP joints at a speed anywhere in a range from about thirty-eight (38) degrees/minute to about five hundred and eight (508) degrees/minute. The ranges are believed adequate to cover the therapeutic needs of about all but ten percent of potential patients. Greater ranges to cover even more potential patients could be provided if desired. For example, forces up to about forty pounds and rotational speeds up to about five hundred (500) degrees per minute might be provided for MCP flexure while forces up to about twenty pounds and rotational speeds up to about twelve hundred (1200) degrees/minute might be provided for composite motion flexure. The CPM drive device 100 is further described with reference to FIG. 16.

Figure 16:
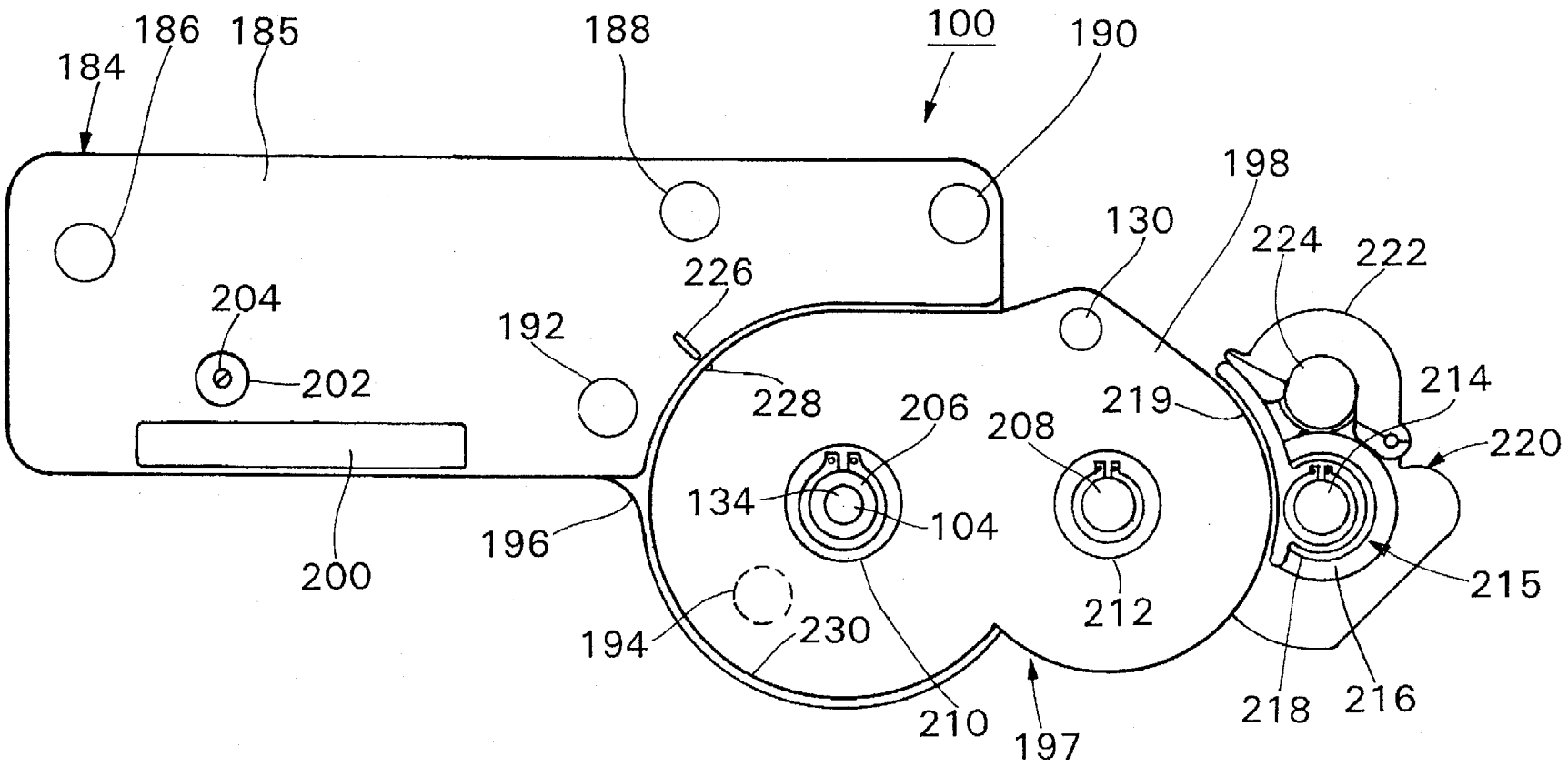
FIG. 16 is a right-side view of the CPM device of the present invention in the fully-extended position.

FIG. 16 is a right-side view of the CPM drive device 100 in its "extended" position. The CPM drive device 100 comprises a main housing 184 formed by two complementary housing members one of which is member 185. The complementary housing members are brought and held together by appropriate fasteners such as screws 186, 188, 190, 192 and 194 that are inserted into member 185 and threadably engaged by appropriate capturing members (not shown) in the remaining complementary member 236 (see FIG. 18). A depression 200 is placed into the housing member 185 (and into a mirror member 236 seen in FIG. 18) to receive a label. An aperture 202 allows for the insertion of a small screw driver so as to adjust a trim potentiometer 204 for calibration of the angle potentiometer 278.

Gear members, to be described, are located in circular portion 196 of main housing 184 and in the main output member 197. The main output member 197 constitutes a first link, also identified at 197 of a three link linkage. First link 197 is defined in part by two pairs of paired, complementary, double generally oval-shaped housing members, an outer one of one pair of the members being member 198. First link 197 is mounted to rotate or pivot around the circular portion 196 of housing 184. First link 197 is pivotably mounted to housing 184 on a hollow shaft 206, the open end of which defines recess 134 and the center line of which defines the drive axis 104. First link 197 supports a second preferably solid shaft 208 having a center line defining a second axis parallel to the drive or first axis 104. Each shaft 206 and 208 is respectively affixed with the link 197 by means of C-rings 210 and 212, respectively. The CPM drive device 100 preferably further comprises a third solid shaft 214 having a center line defining a third axis parallel to the first and second axes. The third shaft 214 is connected to a second link 215 by means of a C-ring 218. The second link 215 is defined by a pair of mirror arms, one being indicated at 216. A geared end of arm 216 is captured between one of the complementary pairs of members including member 198. The distal end of arm 216 extends from the double, generally oval-shaped member 198 of the first link 197. A transverse flange 219 assists in keeping the arm 216 parallel with member 198. The second link 215 supports a third link 220 that has a latch device 222 having an aperture 224 into which is inserted the drive bar support member 162, previously described with reference to FIG. 14. The centerline of aperture 224 and the centerline of drive bar support member 162 captured in the aperture 224 constitute a fourth axis parallel to the first, second and third axes, which is spaced transversely from the third axis on the third link 220 to revolve around the third link motion and follow a substantially epicycloidal curve as will be subsequently explained in greater detail.

Main housing member 185 supports a protrusion 226 while member 198 of the first link 197 supports protrusions 228 and 230, which serve as indicators to visually determine the extent of movement of the double, generally oval-shaped member 198 of the first link 197 by observation of the position of protrusion 226 between comparative position indicators 228 and 230. The extent of movement of the double, generally oval-shaped member 198 comprising the first link 197 is further described with reference to FIG. 17.

Figure 17:
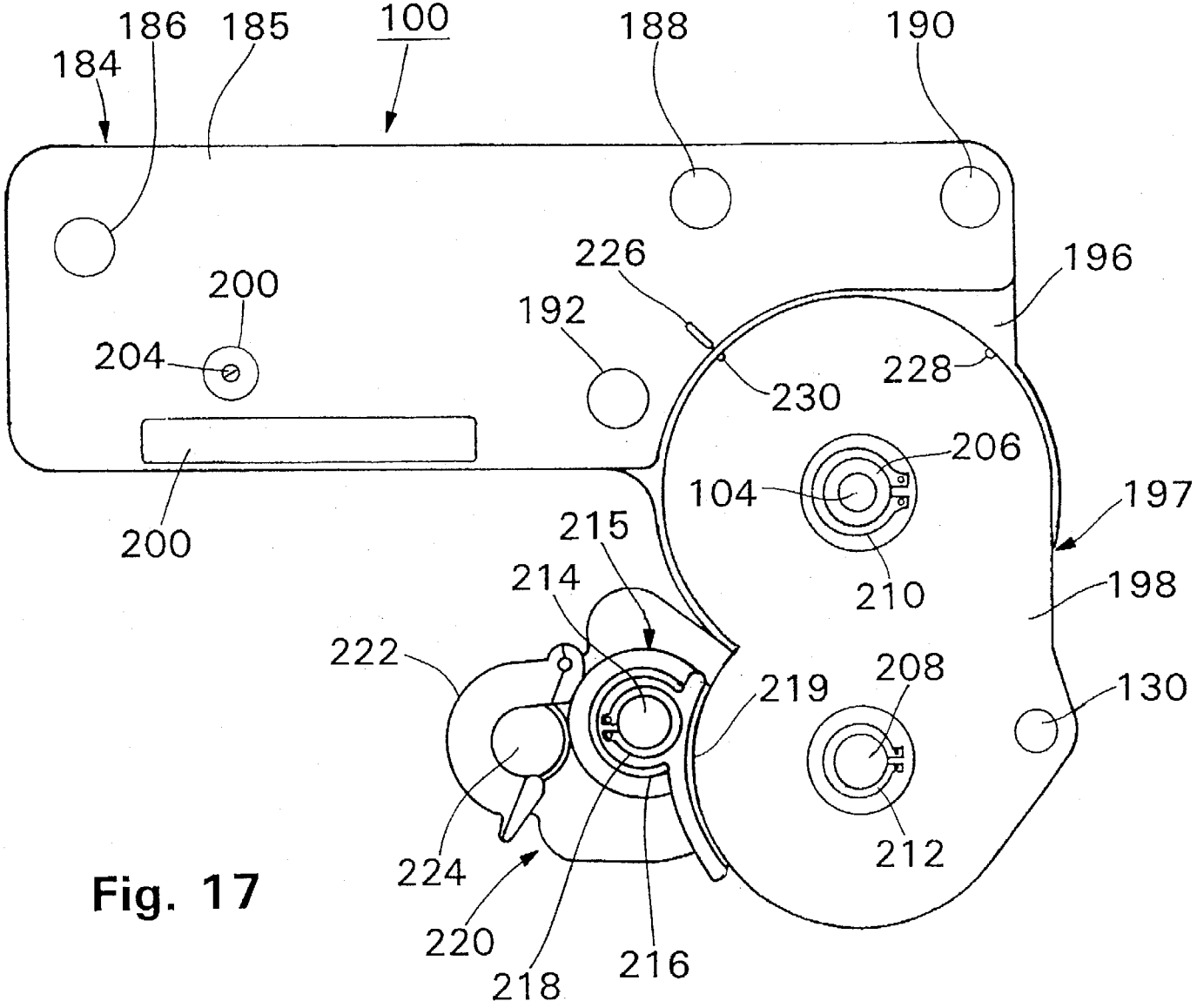
FIG. 17 illustrates the fully-flexed position of the CPM device of the present invention occurring during the therapy of the MCP, DIP and PIP joints of the user's hand.

FIG. 17 illustrates the extent of full rotational movement provided by the CPM drive device 100, which extent is to be further described with reference to FIG. 22. A comparison between FIGS. 17 and 16, more particularly between the indicators 226, 228 and 230 of FIGS. 16 and 17, reveals that the double, generally oval-shaped member 198 of first link 197 experiences about a 90° clockwise rotation during its movement.

Figure 18:
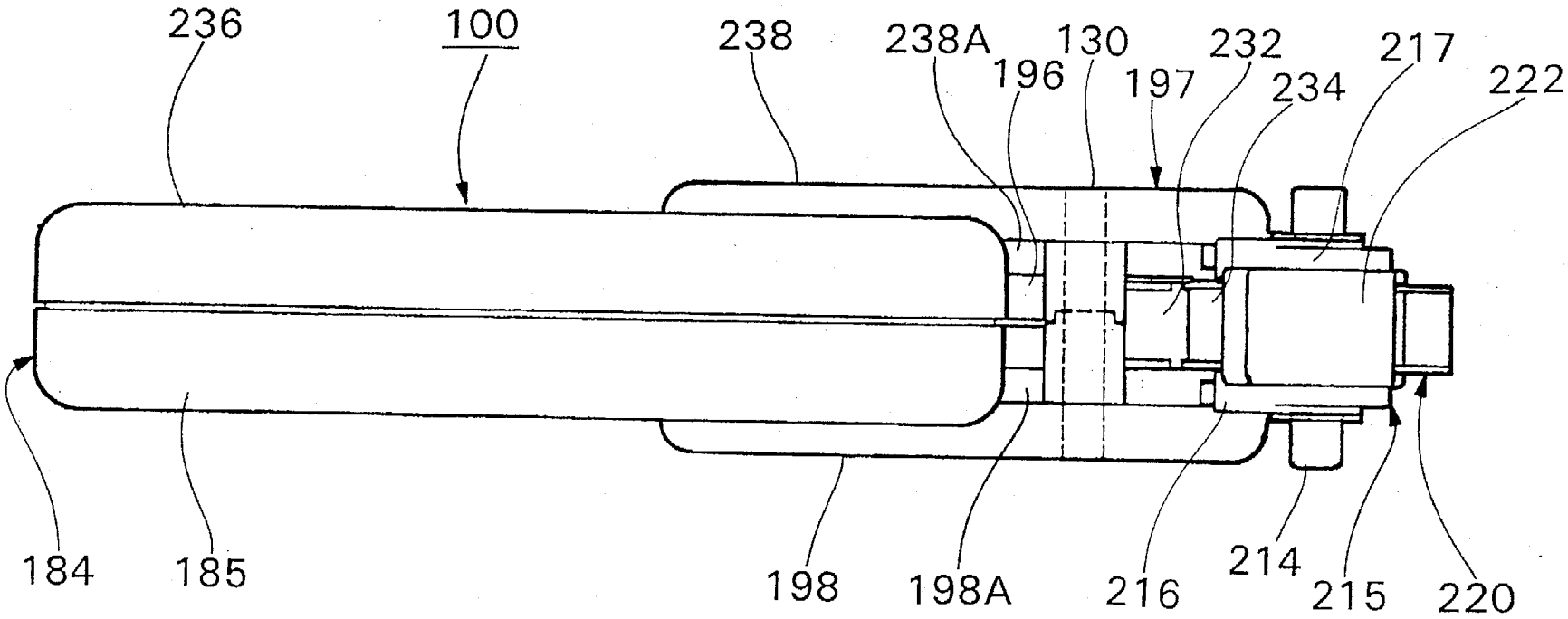
FIG. 18 is a top view of the CPM device of the present invention.

FIG. 18 again illustrates the CPM drive device 100 in its "extended" position (FIG. 16) and generally illustrates gear members 232 and 234, which are located in the middle of CPM drive device 100 and in general correspondence with circular portion 196. FIG. 18 further illustrates the housing member 236, which is a mirror of the housing member 185 previously described. FIG. 18 similarly illustrates an outer member 238, which is a mirror of member 198 and inner members 198A and 238A, which mirror one another and which are complementary with members 198 and 238, respectively. Pairs 198/198A and 238/238A define two spaced apart arms of first link 197, which span the circular portion 196 of main housing 184. FIG. 18 further illustrates an arm 217 which is a mirror of arm 216. Arms 216 and 217, which define the second link 215, span gear members 232 and 234. The location of the components within the housing formed by members 236 and 185 further described with reference to FIG. 19.

As previously discussed with reference to FIG. 15, the CPM drive device 100 receives its input control signals via connector 176. An interface is between the programmable processor 182 and provided by an interconnect and calibration circuit card 177. The card 177 contains a pair of resistors, one of which is in circuit with the magnetic sensor 280. The processor supplies a voltage to the card 177 which is passed through the resistors, linear potentiometer 278 and magnetic sensor 280 and carried back to the processor on two of the conductors. Depending upon the state of switch in the magnetic sensor 280, one of the resistors is shorted out so that either of two voltage levels is passed back to the processor on one of the conductors. Either level identifies the device 100 as a hand type CPM. The actual voltage level indicates whether or not the magnetic tip 129 of member 124 is installed in opening 134. The unshorted state assumes finger-tip supporting bracket member 158 is installed. The board 177 further includes a pair of trim potentiometers to set the zero and span of the linear potentiometers 278. One trim potentiometer 204 is adjustable through housing member 185 (see FIG. 17). The remaining trim potentiometer (not depicted) is similarly exposed through complementary housing member 236 for adjustment on the opposite side of the CPM drive device 100. One conductor back to the programmable processor 182 is dedicated to the output of the linear potentiometer 278. The prime mover is preferably a DC motor 240A coupled with a gear head 240B, which operate in a manner known in the art to drive coupling 244. Details of similar operations may be found in the previously incorporated by reference U.S. patent application Ser. Nos. 08/116,316 and 07/760,424. Linear potentiometer 278 is arranged in circular housing portion of the main housing 238 relative to the main output or first link 197 of the CPM 100 so as to act as a sensor disposed about the hollow output member defined by first shaft to 206. Potentiometer 278 is located to sense the angular position of the link member 197 relative to the fixed housing member 184. The hollow output member 206 is coupled to the motor 240A of the CPM drive device 100 by conventional means, such as a worm gear 243, and worm 242 driven by coupling 244 to the output of gearhead 240B. The worm 242 thus constitutes a rotary drive output of the prime mover. As previously mentioned, the linear potentiometer 278 of the CPM drive device 100 may be that described in U.S. patent application Ser. No. 08/116,316.

Figure 19:
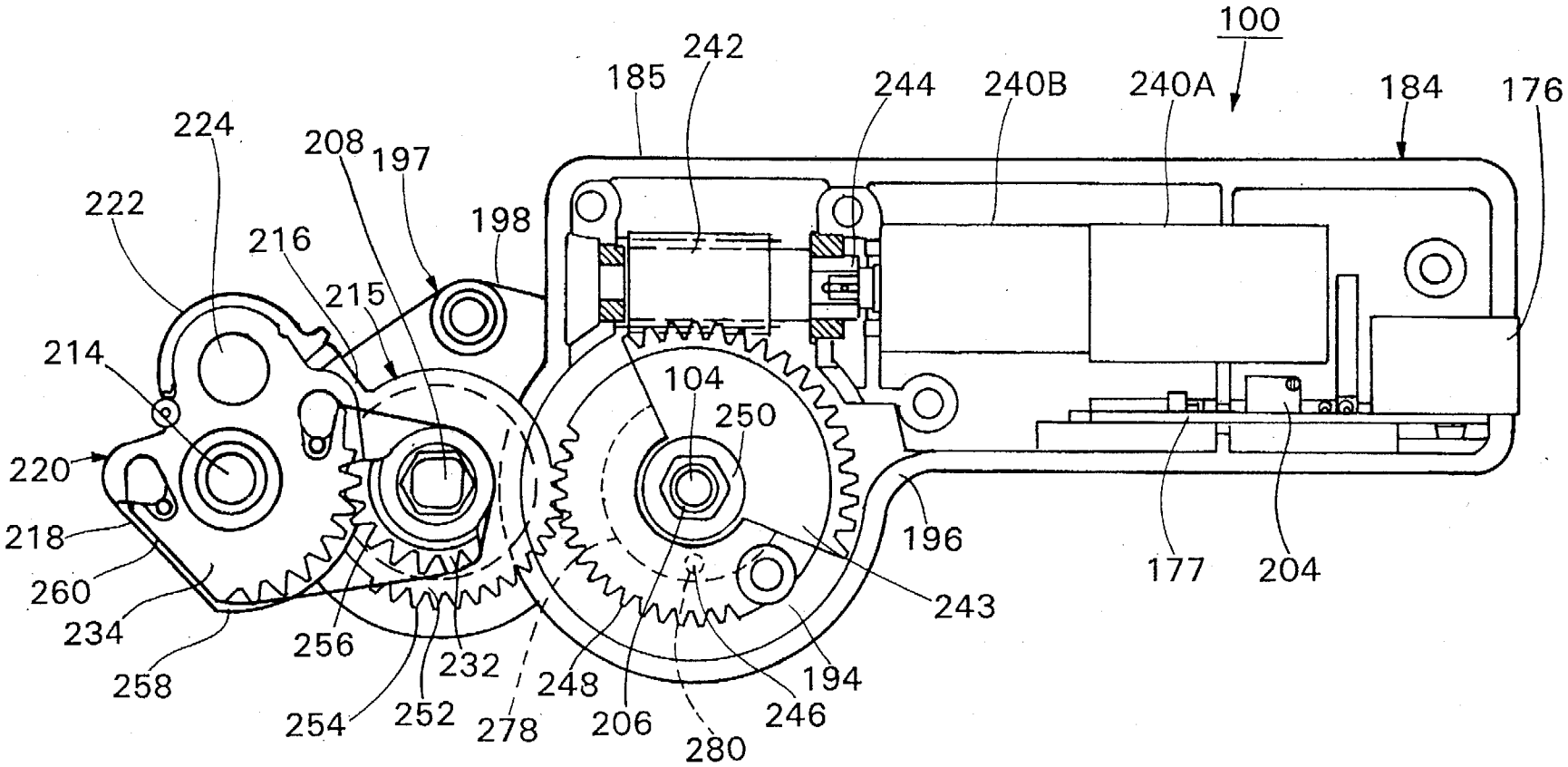
FIG. 19 is a view of the CPM device illustrated in its exposed condition so as to more clearly show its internal components.

FIG. 19 further depicts the three links 197, 215 and 220 and the gearing used to drive the first, second and third links providing the oscillating output of the CPM drive device 100. The first link 197 is coupled with the rotary output member 206 for rotation about a first axis, namely the drive axis 104 described with respect to FIG. 8 and defined by the center line of output member 206, extending generally transverse to the centerline of the splint assembly 10, which was described with reference to FIG. 1. The second link 215 is coupled with the first link 197 for rotation about a second axis defined by a center line of the shaft 208, which is at least substantially parallel to and displaced transversely from the first axis. The third link 220 is coupled with the second link for rotation about a third axis defined by a center line of shaft 214, which is at least generally parallel to and displaced transversely from the first and second axes. The drive bar 158 is coupled to the third link 220 through support member 164, the centerline of which defines a fourth axis generally parallel to and displaced transversely from each of the first, second and third axes.

The first, second and third links 197, 215 and 220 are mutually coupled together for oscillatory movement with the coupling 164 of the drive bar 158 in aperture 224 following a substantially epicycloidal curve via four gears. The first gear 246 having teeth 248 is fixed within circular portion 196 of the fixed housing of CPM drive device 100. Second gear 252 is rotatably supported on second shaft 208 and is a portion of the second link 215. Second gear 252 has teeth 254 that mesh with the teeth 248 of the first gear 246. The previously mentioned gear 232, herein termed "the third gear," has teeth 256 that mesh with the teeth 258 of the previously mentioned gear 234, herein termed "the fourth gear." The second gear 252 is free to rotate on shaft 208 while the third gear 232 is keyed to second shaft 208, which is itself keyed with the first link 197 to prevent rotation with respect to first link 197. Fourth gear 234 is part of the third link 220. A flexible tape member 260 is positioned about teeth 256 and 258, which are substantially coplanar with the central portion 196 of the CPM drive device 100. The tape member 260 serves to prevent the gear teeth 256 and 258 from being inadvertently contacted by the user. More particularly, first gear 246 is one of a mirror pair fixed on either side of the worm gear 243. Gear 252 is similarly one of a mirror pair of gears which are located in housing pairs 198, 198A and 238, 238A comprising the first link 197 (see FIG. 18). Gear 252 and its mirror form the portions of arms 216 and 217 defining the second link 215, which are rotatably captured in the first link 197. The first, second, third and fourth gears 246, 252, 232 and 234 control the movement of the second and third links in response to the movement of the first link, directly driven by the worm gear 243 coupled to prime mover 240A, to provide oscillatory movement at the third link 220, which is defined by a substantially epicycloidal curve and which is further described with reference to FIG. 20.

Figure 20:
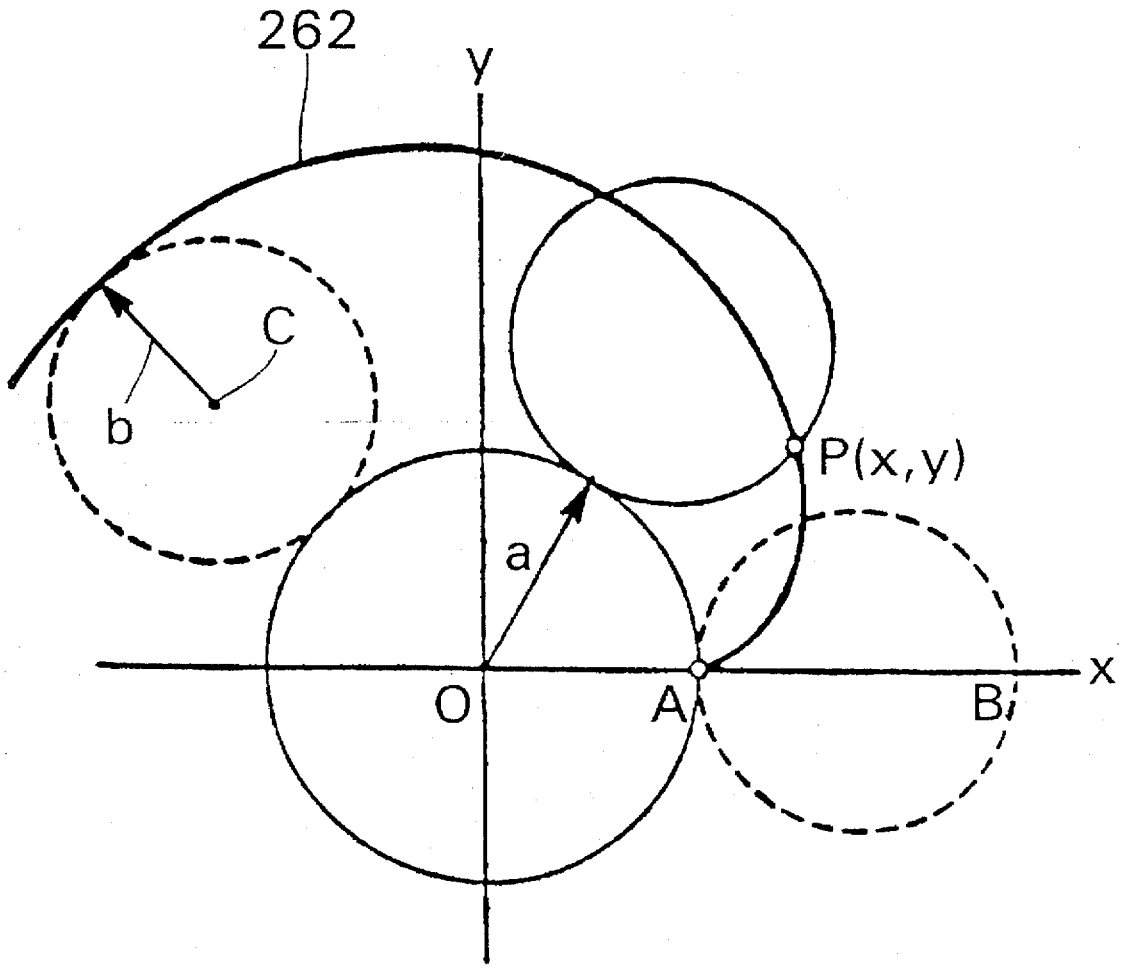
FIG. 20 illustrates a well-known epicycloid curve which corresponds to the desired anatomical path along which the present invention causes the fingers to be pushed into flexion and pulled into extension.

FIG. 20 illustrates a epicycloidal curve 262 which, as known in the art, is formed by a circle having a radius, such as b with an origin C (as shown in FIG. 20), rolling, without slipping, on the outside of a circle having a radius, such as a and with an origin 0 (as shown in FIG. 20). The epicycloidal curve shape of the path by which the first, second and third links of the present invention provide for the movement of the fingers or digits of the user through a 0°–260° range of motion allows for the flexion and extension of each of the treated fingers. The first, second and third links provided by the CPM drive device 100 of the present invention corresponds to a desired first, second and third link anatomical model for the movement of the fingers for therapeutic purposes.

The first anatomical link of the model pivots about a fixed reference representing the MCP joint (hollow shaft 206 defining opening 134 in FIG. 8) and preferably has a 90° range of angular motion. The distal end of the first link is linked, in a pivotal manner, with the second link and represents the PIP joint. This second link provides about 90° or more, desirably more than 90° and preferably about a 100° range of angular motion with respect to the first link, such as nominally occurs when one forms a closed fist. The distal end of the second link is linked, in a pivotal manner, with a proximal end of the third link representing the DIP joint. This third link provides about 90° or less, desirably less than 90° and preferably about 70° of angular motion, with respect to the second link, again, such as nominally occurs when forming a closed fist. When all of the links are axially aligned in a straight line in the extended position, the fingers are fully extended in the initial or 0° position. Conversely, when all of the links are at their extreme rotated position, at the end of their pivoting motion, they are folded into a tight fist. This closed fist condition is usually referred to as the 260° composite position, which is the sum of all of the pivot angles (90°+100°+70°=260°). The tip of the third link as represented by aperture 224 like the tip of a finger, follows a complex curve that can be derived from this three link anatomical model.

More particularly, in the XY coordinate system, the position of the tip of the finger with respect to the rotation of the joint, may be determined from the below Equations 1 and 2, derived by projecting the three link anatomical model on the X and Y axes, with the MCP joint serving as the origin:

$$Tip_x = A^* \cos(Q_a) + B^* \cos(Q_a + Q_b) + C^* \cos(Q_a + Q_b + Q_c) \quad \text{Equation (1)}$$

$$Tip_y = A^* \sin(Q_a) + B^* \sin(Q_a + Q_b) + C^* \sin(Q_a + Q_b + Q_c) \quad \text{Equation (2)}$$

where A, B, C represent the lengths of the three anatomical links, and $Q_a$, $Q_b$, $Q_c$ represent the angles of each joint (MCP, DIP and PIP).

As previously mentioned in the "Background" section, the finger bones are surrounded by soft tissues through which the mobilizing forces are to be transmitted to cause motion of the finger joint. Also the motion causing force should have no axial component with respect to the point of the force application to the finger, in order not to cause joint expansion (pulling the joint apart) or compression (pushing the joint together). In other words, the motion causing force provided to the fingers should be perpendicular to the bone which is caused to rotate about its joint. This perpendicular force also causes minimum motion of the tissues with respect to the bones and, thereby, minimum tissue irritation. The angle at which the force is applied to the finger is commonly referred to as the force angle. This force angle should be perpendicular to the orientation of the link that is causing the finger to pivot. In the three link anatomical model related to the present invention, assuming a composite motion force is applied to a typical finger, the force angle should be perpendicular to the third link, which has the following angle (C angle) with respect to the original position (MCP joint).

$$C_{angle} = Q_a + Q_b + Q_c \quad \text{Equation (3)}$$

The preferred anatomical values, given in Equations (1)–(3), that yield the proper therapeutic effects for the fingers being treated in the composite mode, that is, 0°–260° range of motion associated with the MCP, DIP and PIP joints, have the preferred values given in Table 1.

TABLE 1

| QUANTITY | VALUE |
|---|---|
| A | 1.25 inches |
| B | 1.0 inches |
| C | 0.56 inches |
| $Q_a$ | 90° |
| $Q_b$ | $Q_a$ * 10/9 |
| $Q_c$ | $Q_a$ * 7/9 |

To provide for the proper flexion and extension of the fingers to advantageously accomplish recuperative therapy, the fingers should be caused to be pushed into flexion and pulled into extension by following a path defined by a modified epicycloidal curve. This epicycloidal path is provided by the first, second, third and fourth gears 246, 252, 232 and 234 respectively shown in FIG. 19 which control the composite movement of the first, second and third pivotal link mechanism of the present invention. The three link pivotal mechanism has a range of motion, corresponding to the range of motion of the three link anatomical model of the fingers and each link of the mechanism has a fixed ratio with respect to each other. The three link pivotal mechanism of the present invention may be defined by Equations 4, 5 and 6 given below, and provide a 0° force angle rotation with respect to the finger receiving the therapy $$X = (R1+R2)\cos(Q_a) + (R3+R4)\cos(Q_a(1+R1+R2) + (R4)\cos(Q_a(1+R1/R2+R1R3/R2R4) \quad \text{Equation (4)}$$

$$y = (R1+R2)\sin(Q_a) + (R3+R4)\sin(Q_a(1+R1+R2) + (R4)\sin(Q_a(1+R1/R2+R1R3/R2R4) \quad \text{Equation (5)}$$

$$F_{angle} = Q_a(1+R1/R2+R1R3/R2R4) \quad \text{Equation (6)}$$

where R1, R2, R3 and R4 are the respective radii of the gears 246, 252, 232 and 234. The path provided by the four gears 246, 252, 232 and 234 of the three link mechanism of the present invention may be further described with reference to FIGS. 21(A) and (B).

Figure 21A:
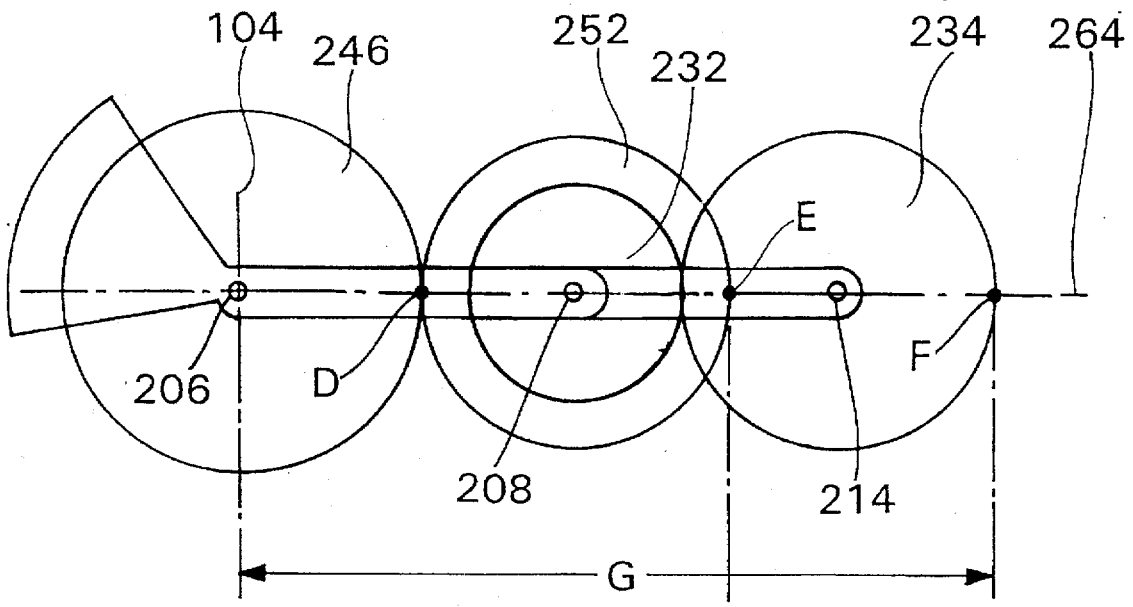
FIGS. 21(A) and (B) illustrate the perpendicular force that is applied by the practice of the present invention to the fingers of the user receiving recuperative therapy.

FIG. 21(A) illustrates the "extended" position of the links (197, 215 and 220) and initial (0°) positions of the gears (246, 252, 232 and 234) of the CPM drive device 100. As seen in FIG. 21(A) the shaft 206, about which the first gear 246 rotates, the shaft 208 about which the second gear 252 and third gear 232 rotate, and the third shaft 214 about which the fourth gear 234 rotates are all coaxial as indicated by dimensional line 264. Further, as previously discussed, the transverse axis of shaft 206 forms the drive axis 104 of the CPM drive device 100 which is in coincidence with the MCP joint 94 previously discussed (see FIG. 8). Further, as seen in FIG. 21(A), point D which corresponds to the tip of the radius of the first gear 246, point E which corresponds to the tip of the radius of the second gear 252, and point F which corresponds to the tip of the radius of the fourth gear 234 are also initially coincidental with respective to each other and are all coaxial with the dimensional line 264. The overall longitudinal distance covered by points D, E and F is indicated by reference symbol G as shown in FIG. 21(A). As further seen in FIG. 21(A), the force angle f is perpendicular to the drive axis 104.

Figure 21B:
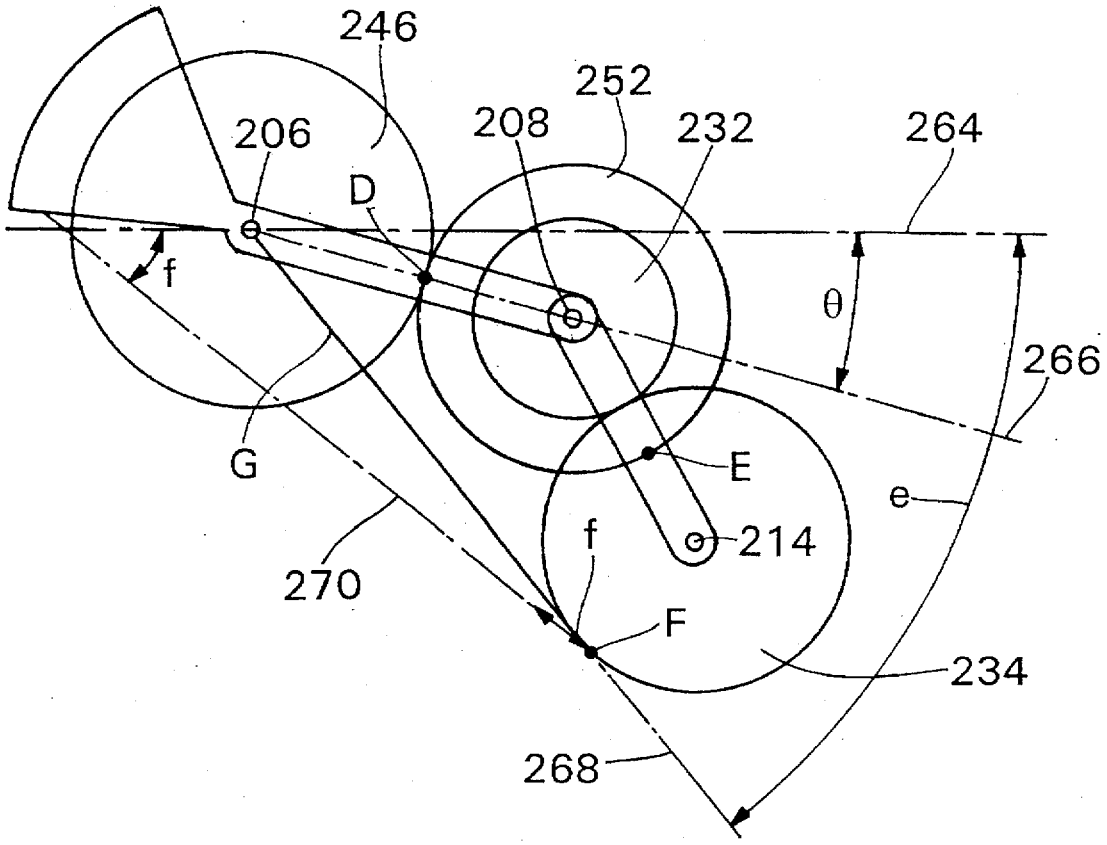

FIG. 21(B) indicates the new positions of the points D, E and F when the gear train comprising gears 246, 252, 232 and 234 encounter movement. As seen in FIG. 21(B), the point D moves by an angle e which is defined by the dimensional lines 264 and 266. As further seen in FIG. 21(B), point E moves to a position below the dimensional line 266, whereas the point F also moves to a position below the dimensional line 266 and is defined by an angle e which, in turn, is defined by the distance between dimensional lines 264 and 268. The force angle f applied at point F is referenced back, as indicated by dimensional line 270, to the dimensional line 264.

A review of FIGS. 21(A) and (B) reveals that the force angle f is always perpendicular to point F no matter what orientation of the gears 246, 252, 232 or 234 are placed. The parameters of the gears 246, 252, 232 and 234 are further described with reference to FIGS. 22(A)–22(C).

FIG. 22(A) illustrates the geometric parameters of the gears 246, 252, 232 and 234 rotating the first, second and third links of the present invention. FIG. 22(B) indicates the substantially epicycloidal path provided by the first, second and third links 197, 215 and 220, which move the fingers through the composite mode (0°–260°) of therapy. FIG. 22(C) illustrates the interrelationship between the CPM drive device 100 and the flexion and extension epicycloidal path provided for the therapy of the fingers. The preferred parameters indicated in FIG. 22(A) are given in Table 2.

TABLE 2

| REFERENCE LETTER | QUANTITY | TYPICAL VALUE GIVEN IN INCHES |
|---|---|---|
| A | Length of the first link between 1st and 2nd axes | 1.25 |
| B | Length of the second link between 2nd and 3rd axes | 1.0 |
| C | Length of the third link between 3rd and 4th axes | 0.557 |
| H | Distance between the center of gear 246 and the tip of the radius of gear 252 | 1.844 |
| I | Distance between the center of gear 246 and the tip of the radius of gear 234 | 2.834 |
| J | Radius of gear 246 | 0.656 |
| K | Radius of gear 252 | 0.554 |
| L | Radius of gear 232 | 0.417 |
| M | Radius of gear 234 | 0.584 |
| N | Separation between the center of the third shaft 214 and the center 158a of drive rod 158 | 0.534 |

FIG. 22(B) indicates points O, P, Q, and R which respectively correspond to the center of the shaft 206 and also the drive axis 104, the center of shaft 208, and the center of shaft 214 and the center of shaft 158. Further, points O, P, and Q respectively represent the first, second and third pivots of the first, second and third links. The distance between points O and P corresponds to the parameter A of Table 2 and Equations 1 and 2, which is the length of the first link between the centers of shafts 206 and 208; the distance between points P and Q corresponds to the parameter B of Table 2 and the Equations 1 and 2, which is the length of the second link between the centers of shafts 208 and 216 and the distance between the point Q and 158 corresponds to the parameter C of Table 2 and Equations 1 and 2, which is the length of the third link between the center of shaft 214 and force application points at the center of aperture 224. Also shown in FIG. 22(B) is a tip of a finger indicated by reference number 272 on which is placed under the rod 158. The tip of the finger 272 is moved along by rod 158 so as to follow the modified epicycloidal curve 274.

A review of FIG. 22(B) reveals that the tip of the finger 272 has an initial position (0°) parallel to the origin point O and prints P and Q and a final position (260°) indicated on the left side of FIG. 22(B) as being below origin point O. The finger tip 272 is moved by a total of 260°. A further review of FIG. 22(B) reveals the predetermined paths followed by the points P, Q and R. More particularly, from FIG. 22(B) it may be seen that the movement of the first link indicated by the movement of point P is only and preferably about 90°, whereas the movement of point Q indicative of the motion of the second link with respect to the first link is about 90° or more, desirably more than 90° and preferably about 100°, so that the overall movement of point Q is about 190°. Furthermore, the movement of the third link indicated by the movement of the center 158A of rod 158 is about 90° or less, desirably less than 90° and preferably about 70°, so that the overall movement of point R is about 260°. The movement of the first, second and third links is further described with reference to FIG. 22(C).

FIG. 22(C) indicates the initial position of the finger tip 272 now shown as extending from the body 272A of a typical finger and also that the MCP joint 94 (located at one end of body 272A) is in alignment with the drive axis 104 of the CPM drive device 100. FIG. 22(C) illustrates that when the CPM drive device 100 is activated, it causes the rod 158 to apply a force, more particularly as previously discussed with reference to FIG. 21, a perpendicular force to the finger tip 272, so that the finger tip 272 is moved through its 0°–260° of composite mode therapeutic treatment. As seen in FIG. 22(C), when the finger tip 272 has moved through the 260° of rotation (indicated in phantom in FIG. 22(C)), it is positioned on the opposite side of the double, generally oval-shaped member 198 forming part of first link 197, against that link. This 260° composite movement therapeutically treats all the MCP, DIP and PIP joints of the finger. The torque and the force applied to the tip of the finger 272 is determined by the programmable controller 182 generally illustrated in FIG. 15.

It should now be appreciated that the practice of the present invention provides for a CPM drive device 100 for the human hand which mobilizes the joints of the fingers in an anatomically correct composite motion, and does not produce joint expansion or compression, and minimizes any irritation to the tissues surrounding the bones of the fingers. The CPM drive device 100 is also capable of producing MCP joint motion only. The preferred range of the MCP joint motion is from 0° to 90°, whereas the preferred range of the composite motion is from 0° to 260° to therapeutically treat all the joints (MCP, DIP and PIP) of the fingers.

Operation of the device 10 is as follows. Initially, an appropriate palmar splint 76 (FIG. 2) is selected for the user. The selected splint is trimmed and a foam liner 78 is applied to the splint, if indicated (FIG. 3); foam liner 84 is applied to the underside of the palmar retainer 60 (FIG. 4). If wrist immobilization is indicated, the palmar retainer 60 is joined with the remainder of the splint assembly 20 by attaching the palmar retainer 60 to the second adjustment arm 26 (FIG. 6 and 1). The first section 20 is secured to the patient's forearm through straps 46/48, 50/52 (FIG. 1). The proximal/distal position of the platform 38 is adjusted by loosening screw 30 and positioning the first portion 20 comfortably to avoid ulnar and radial styloid (FIGS. 1 and 11). Confirmation that the palmar retainer 60 is centered on the dorsum of the hand is made by adjusting the ulnar strap. The wrist angle of the splint assembly 20 is next adjusted by loosening first fastener 18, which should be at the wrist axis, positioning the user's hand at the desired angle and retightening the first fastener 18. The drive axis 104 of the CPM drive device 100 is aligned with the MCP of the user's fifth digit by loosening adjustment screw 106 and adjusting the position of CPM drive device 100 proximally or distally along bidirectional arrow 102 and vertically along bidirectional arrow 103 until the drive axis 104 and MCP joint axis 94 (FIG. 7) are substantially coincident. CPM drive device 100 is further aligned dorsally/volarly and distally/proximally along axis 98A/98C and 98B/98D (FIG. 6) before adjustment screw 36 is retightened into the palmar retainer 60. Again, if desired, the device can be used without the forearm splint portion provided by platform 36 and associated straps 46/48, 50/52 by removing the second adjustment arm 26 from the palmar retainer 60 and reversing the cup washer 58 from the position shown in FIG. 1 to account for the difference in spacing between the cup washer 58 and palmar retainer 60 from the removal of the second arm 26.

The device 10 provides three options for use: isolated MCP joint motion, composite motion of MCP, PIP and DIP joints and isolated PIP and DIP joint motion.

Isolated MCP joint motion is accomplished by fitting the transverse member 110 to the proximal phalanges and to the CPM drive device 100, as previously described in connection with FIG. 8, or by adhering finger attachment straps 150 to all or as many of the proximal phalanges as desired and thereafter coupling drive bar 157 to the finger attachment straps 146 and to the CPM drive unit 100 in the manner depicted in FIG. 10(A) and 10(B).

For full composite movement of the MCP, CIP and DIP joints, straps 146 are secured to the volar aspect of the distal phalanx (as shown in FIG. 12) for each of the digits 148, 166, 168 and 170 (FIG. 13(A)). The drive bar 158 is bent in the manner described with respect to FIG. 13(A) to proximate the user's varying finger lengths. The drive bar support assembly members 162 and 164 are loosely secured to the drive bar 158 with the member 162 in the appropriate orientation (FIG. 13(A) or (B)), depending upon the length of the user's fingers. The upper portion 112 of transverse member 110 is again secured to the first link 197 of the drive unit 100 through opening 130 and secured to the proximal phalanges with second member 114 through hook and loop straps 116 through either end. Drive bar end cap 160 is removed, the drive bar 158 is threaded through the aperture 152 of each strap 146 and the cap 160 remounted to retain the straps 146 on bar 158. Latch member 222 is opened and the end of drive bar support member 164 inserted into aperture 224 and secured with the latch member 222 (see FIG. 16).

For flexing of just the DIP and PIP joints, the finger straps 146 and drive bar 158 are mounted and coupled to the drive unit 100 as just described and the transverse member 110 fixedly coupled to the palmar retainer 60 in the manner depicted and described with respect to FIG. 9(A) and 9(B).

The desired output torque and the desired angular rotation rate of the first link 197 for MCP joint flexion, or other flexion with the DIP and PIP joints, are programmed into the processor 182. The processor distinguishes between MCP flexor configurations of the unit shown in FIGS. 8 and 10(B) and other configurations by the presence of the magnetic tip 129 in opening 134 as previously noted. The processor 182 preferably supplies motor current pulses to the motor 240A through two of the conductors of cable 178. Torque output of the motor 240A is determined by current measurement while motor speed is determined by back EMF in the conductors between pulses. Torque of motor 240A is proportional to average current while angular rotation of motor 240A is proportional to the back EMF. Rotational speed and torque to the first and third, links 197 and 220 can thus be determined. Polarity of the current pulses is reversed by the processor 182 to reverse the movement of the links 197, 215, 220, thereby providing the oscillatory or reciprocating modified epicycloidal movement.

A C-channel element 164a of member 164, seen in plan in FIGS. 13(A) and (B) and in perspective in FIG. 14 adjoining bar 158 where the bar meets CPM drive device 100, is fitted over shaft 214 while inner circumferential flanges on either side of member 222 fit into circumferential grooves on member 164 to fixedly secure drive bar 158 with the third link 220 without free rotation of the bar 158 around shaft 214 or member 164.

It will be appreciated by those skilled in the art that changes and modifications may be made to the above described embodiments without departing from the inventive concept thereof. It is understood, therefore, that the present invention is not limited to the particular embodiments disclosed, but is intended to include all modifications and changes which are within the scope and spirit of the invention as defined by the appended claims.

What we claim is:

1. A therapeutic passive motion device for effecting movement of a user's hand comprising carpal, metacarpal and phalanges bones, the carpal bones forming the wrist that is connected to the forearm of the user, said passive motion device comprising:

(a) a hollow splint assembly having a centerline and configured to be secured around at least one of a forearm and a hand of a user;

(b) a prime mover coupled with the splint assembly and including a rotary drive output, the prime mover being supported to one side of the splint assembly so as to be located on one side of the user's hand when the splint assembly is worn by the user;

(c) a first link coupled with the rotary drive output for rotation about a first axis extending generally transversely to the centerline of the splint assembly the first axis being displaced transversely from the rotary drive output;

(d) a second link coupled with the first link for rotation about a second axis at least substantially parallel to and displaced transversely from the first axis, the second axis passing through the first link and the second link;

(e) a third link coupled with the second link for rotation about a third axis at least generally parallel to and displaced transversely from each of the first and second axes, the third axis passing through the second link and the third link; and (f) a coupling extending transversely from one of the links at a point displaced transversely from each of the axes and configured to be secured with either a palm or fingers of the hand of the user.

2. The therapeutic passive motion device of claim 1, wherein said first, second and third links are mutually coupled together by coupling means for oscillating at least the third link along a substantially epicycloidal curve.

3. The therapeutic passive motion device of claim 1, wherein said prime mover is capable of oscillating said first link about said first axis over an angular range at least substantially equal to a full range of nominal angular movement of a metacarpophalangeal joint;

wherein said second link is adapted to rotate about the second axis over an angular range at least substantially equal to a full range of nominal angular movement of a proximal phalanges (PIP) joint; and wherein said third link is adapted to rotate with respect to said second link about the third axis over an angular range at least substantially equal to a full range of nominal angular movement of a distal phalanges (DIP) joint;

whereby angular range of movements of the first, second and third links can be used to substantially duplicate angular movements of flexing fingers of a human hand.

4. The therapeutic passive motion device of claim 1, wherein the range of motion of the first link is about 90°;

wherein the range of motion of the second link with respect to the first link is about 90° or more; and wherein the range of motion of the third link with respect to the second link is about 90° or less.

5. The therapeutic passive motion device of claim 4:

wherein the range of motion of the second link with respect to the first link is more than 90°; and wherein the range of motion of the third link with respect to the second link is less than 90°.

6. The therapeutic passive motion device of claim 3, wherein the first and second axes are spaced apart from each other by a distance of about one and one-quarter inches, the second and third axes are spaced apart from one another by a distance of about one inch.

7. The therapeutic passive motion device of claim 3 further comprising a processor means operatively coupled with the prime mover and programmed for controlling the prime mover to move the first link over its range of motion.

8. The therapeutic passive motion device of claim 7, wherein said processor means is programmed for applying a force within a range from about thirty-two (32) ounces to about three hundred and twenty (320) ounces through the first link.

9. The therapeutic passive motion device of claim 8, wherein said processor means is programmed for moving said first link at an angular rate within a range of from about fourteen (14) degrees/minute to about one hundred and seventy-six (176) degrees/minute.

10. The therapeutic passive motion device of claim 7, wherein said processor means is programmed for applying a force within a range from about five (5) ounces to about eighty (80) ounces through the third link.

11. The therapeutic passive motion device of claim 10, wherein said processor means is programmed for moving said third link at an angular rate within a range from about thirty-eight (38) degrees/minute to about five hundred and eight (508) degrees/minute.

12. The therapeutic passive motion device of claim 1 wherein the coupling comprises a finger-engaging drive bar extending transversely from the third link generally toward the centerline of the splint assembly in at least an initial orientation of the device, and the drive bar being spaced with respect to the splint assembly and configured to receive extreme distal ends of a user's fingers.

13. The therapeutic passive motion device of claim 12, wherein the drive bar is coupled with the third link along a fourth axis to rotate with the third link, the fourth axis being transversely spaced about one-half inch from the third axis.

14. The therapeutic passive motion device of claim 1 further comprising a member with gear teeth, the member being located on the second axis and wherein said third link includes gear teeth engaged with the gear teeth of the member located on the second axis.

15. The therapeutic passive motion device of claim 1, wherein the splint assembly has releasably joined first and second sections respectively positionable and adjustable along the user's forearm and hand.

16. The therapeutic passive motion device of claim 15, wherein said first section comprises a first adjustment arm and said second section comprises a second adjustment arm, the first and second adjustment arms being separably coupled to each other by a first fastener.

17. The therapeutic passive motion device of to claim 16, wherein the first section further comprises a first at least substantially rigid platform adjustably coupled with the first adjustment arm.

18. The therapeutic passive motion device of claim 16, wherein the prime mover is located in a housing and wherein second section comprises:

a second platform adjustably coupled with the second adjustment arm; and a pocket member coupled with the second platform and dimensioned to accept and support the prime mover housing.

19. The therapeutic passive motion device of claim 18 further comprising a transverse member spaced apart from said second adjustment arm, said transverse member being securable around a portion of the user's fingers.

20. The therapeutic passive motion device according to claim 19, further comprising an opening in one of said first, second and third links parallel to said first transverse axis and wherein said first transverse member further includes a rod having an end releasably attached to said parallel opening.

21. The therapeutic passive motion device of claim 1, wherein the hollow splint assembly is adapted to be secured around a palm of the user's hand and the coupling further comprising a first transverse member spaced apart from the hollow splint assembly, said transverse member being adapted to be secured around portions of a user's fingers and said first transverse member further having an end releasably secured with one of the first and third links along an axis substantially parallel with the first transverse axis.

22. The therapeutic passive motion device of claim 21, wherein the first transverse member is releasably coupled with the third link.

23. The therapeutic passive motion device of claim 21, wherein the first transverse member is releasably secured with the first link spaced transversely from the first transverse axis.

24. The therapeutic passive motion device of claim 23 further comprising a second transverse member configured to be secured around a portion of the user's fingers and further having an end releasably secured with the third link along an axis substantially parallel with the first transverse axis.

25. The therapeutic passive motion device of claim 23, wherein the first transverse member further include an end releasably coupled with the first link along the first transverse axis.

26. The therapeutic passive motion device of claim 1 further comprising a hollow output member positioned about the first transverse axis, a sensor means located for sensing the angular position of the first link, and the coupling comprising a transverse member having an upper section, the transverse member further having a control arm with a first end connected to the upper section and a second end insertable into the hollow output member at a location where the second end of said control arm also can be sensed by the sensor means.

27. The therapeutic passive motion device according to claim 1, wherein said third link has a latch.

28. The therapeutic passive motion device according to claim 27, the coupling further comprising;

(a) at least one strap member having a loop member on its outer surface; and (b) a bar member having first and second end sections with the first end section insertable into said loop member and the second end section connected with said third link.

29. A therapeutic passive motion device for effecting movement of a user's hand comprising carpal, metacarpal and phalanges bones, the carpal bones forming the wrist that is connected to the forearm of the user, said passive motion device comprising:

(a) a hollow splint assembly having a centerline and configured to be secured around at least one of a forearm and a hand of a user;

(b) a prime mover;

(c) a first gear centered on a first axis;

(d) a first link rotated about the first axis by the prime mover;

(e) a second gear rotatably supported on a second axis through the first link, generally parallel with and spaced transversely from the first axis, the second gear being meshed with the first gear to rotate about the first gear on the second axis;

(f) a third gear fixed on the second axis;

(g) a fourth gear meshed with the third gear to rotate about a third axis generally parallel with and spaced transversely from the first and second axes; and (h) a coupling extending from one of the first link and the fourth gear at a point spaced traversely from each of the axes and configured to be secured with either a palm or fingers of the hand of the user.

30. The therapeutic passive motion device of claim 29 further comprising a second link bearing the second and third gears and a third link bearing the fourth gear.

31. A therapeutic passive motion device for effecting movement of a user's hand comprising carpal, metacarpal and phalanges bones, the carpal bones forming the wrist that is connected to the forearm of the user, said passive motion device comprising:

(a) a hollow splint assembly having a centerline and configured to be secured around at least one of a forearm and a hand of a user;

(b) a prime mover coupled with the splint assembly and including a rotary output member, the prime mover being supported to one side of the splint assembly so as to be located on one side of the user's hand when the splint assembly is worn by the user;

(c) a first link coupled with the rotary output member for rotation about a first axis extending generally transversely to the centerline of the splint assembly;

(d) a second link coupled with the first link for rotation about a second axis at least substantially parallel to and displaced transversely from the first axis;

(e) a third link coupled with the second link for rotation about a third axis at least generally parallel to and displaced transversely from each of the first and second axes;

(f) a hollow output member about the first transverse axis and a sensor located to sense the angular position of said first link; and (g) a transverse member adapted to be secured around the fingers of the user's hand proximal the metacarpophalangeal joints and having an upper section, said transverse member further having a control arm with a first end connected to said upper section and a second end insertable into said hollow output member at a location where said second end of said rod can be sensed by the sensor.

32. A therapeutic passive motion device for effecting movement of a user's hand comprising carpal, metacarpal and phalanges bones, the carpal bones forming the wrist that is connected to the forearm of the user, said passive motion device comprising:

(a) a hollow splint assembly having a centerline and configured to be secured around at least one of a forearm and a hand of a user;

(b) a prime mover coupled with the splint assembly and including a rotary output member, the prime mover being supported to one side of the splint assembly so as to be located on one side of the user's hand when the splint assembly is worn by the user;

(c) a first link coupled with the rotary output member for rotation about a first axis extending generally transversely to the centerline of the splint assembly;

(d) a second link coupled with the first link for rotation about a second axis at least substantially parallel to and displaced transversely from the first axis;

(e) a third link coupled with the second link for rotation about a third axis at least generally parallel to and displaced transversely from each of the first and second axes, said third link having a latch;

(f) at least one strap member releasably attached to a tip portion of at least one finger of the user's hand and having a loop member on its outer surface; and (g) a bar member having first and second end sections with the first end section insertable into said loop member and connected with said third link.

* * * * *